US009448539B2

(12) United States Patent
Akiyama

(10) Patent No.: US 9,448,539 B2
(45) Date of Patent: Sep. 20, 2016

(54) ELECTRONIC TIMEPIECE AND RECEPTION CONTROL METHOD OF AN ELECTRONIC TIMEPIECE

(71) Applicant: Seiko Epson Corporation, Tokyo (JP)

(72) Inventor: Toshikazu Akiyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,693

(22) Filed: Mar. 19, 2014

(65) Prior Publication Data

US 2014/0293756 A1 Oct. 2, 2014

(30) Foreign Application Priority Data

Mar. 29, 2013 (JP) ..... 2013-072717

(51) Int. Cl.

*G04R 20/00* (2013.01)
*G04R 20/02* (2013.01)
*G04R 20/04* (2013.01)
*G04R 20/06* (2013.01)

(52) U.S. Cl.

CPC ..... *G04R 20/02* (2013.01); *G04R 20/00* (2013.01); *G04R 20/04* (2013.01); *G04R 20/06* (2013.01)

(58) Field of Classification Search

CPC ..... G04R 20/00; G04R 20/02; G04R 20/04; G04R 20/06
USPC ..... 368/47
See application file for complete search history.

(56) References Cited

U.S. PATENT DOCUMENTS

| | | | | |
|---|---|---|---|---|
| 5,923,618 | A * | 7/1999 | Nelson et al. | 368/47 |
| 7,447,931 | B1 * | 11/2008 | Rischar et al. | 368/47 |
| 7,948,833 | B2 * | 5/2011 | Ha et al. | 368/47 |
| 8,514,667 | B2 | 8/2013 | Akiyama et al. | |
| 2008/0165626 | A1 | 7/2008 | Urano | |
| 2008/0165628 | A1 * | 7/2008 | Urano | 368/47 |
| 2009/0129206 | A1 * | 5/2009 | Baba | 368/14 |
| 2010/0214165 | A1 * | 8/2010 | Baba | 342/357.12 |
| 2012/0188854 | A1 * | 7/2012 | Baba | 368/47 |
| 2012/0201101 | A1 * | 8/2012 | Akiyama et al. | 368/47 |
| 2012/0243383 | A1 * | 9/2012 | Honda | 368/47 |
| 2013/0003506 | A1 * | 1/2013 | Kato et al. | 368/47 |

FOREIGN PATENT DOCUMENTS

| | | |
|---|---|---|
| JP | 2009-250801 | 10/2009 |
| JP | 2011-033381 | 2/2011 |
| JP | 2011-208951 | 10/2011 |
| JP | 2012-026774 | 2/2012 |
| JP | 2012-167931 | 9/2012 |
| JP | 2012-202875 | 10/2012 |

* cited by examiner

*Primary Examiner* — Amy Cohen Johnson
*Assistant Examiner* — Daniel Wicklund

(57) ABSTRACT

An electronic timepiece has a receiver device that receives at least a first satellite signal containing a first leap second value and a second satellite signal containing a second leap second value; a timekeeping device that keeps time according to the current leap second; an evaluation condition setting unit that sets an evaluation condition of the correctness of the first leap second value and the second leap second value based on the timing of first satellite signal and second satellite signal reception; and a leap second correction unit that corrects the current leap second based on the first leap second value or the second leap second value when the first leap second value and the second leap second value satisfy the set evaluation condition.

15 Claims, 16 Drawing Sheets

ELECTRONIC TIMEPIECE AND RECEPTION CONTROL METHOD OF AN ELECTRONIC TIMEPIECE

BACKGROUND

1. Technical Field

The present invention relates to an electronic timepiece that adjusts the time by receiving satellite signals transmitted from a positioning information satellite, and to a reception control method of the electronic timepiece.

2. Related Art

To correct the time by receiving satellite signals transmitted from GPS (Global Positioning System) satellites, the current leap second value must be acquired and reflected in the corrected time. JP-A-2012-167931 teaches an electronic timepiece that can easily acquire the time when the leap second value can be received with a minimal processor load.

JP-A-2012-167931 more specifically teaches using parity data contained in the satellite signal to check if the GPS time (Z count) can be trusted.

This means that whether or not the leap second value can be trusted can conceivably also be determined using a parity check.

As shown in FIG. 16, however, our tests have shown that there are instances in which the actual leap second value is incorrect even though the leap second value passes the parity check. More specifically, an error was found 5% to 10% of the time when the signal strength is low (−144 to −145 dBm).

As a result, determining with a high degree of accuracy if the correct leap second value was received is not possible using a parity check alone.

SUMMARY

An electronic timepiece and a reception control method of an electronic timepiece according to the present invention can determine with a high degree of accuracy if the correct leap second value was received.

An electronic timepiece according to one aspect of the invention has a receiver unit that receives at least a first satellite signal containing a first leap second value and a second satellite signal containing a second leap second value; a timekeeping unit that keeps time according to the current leap second; an evaluation condition setting unit that sets an evaluation condition of the correctness of the first leap second value and the second leap second value based on the timing of first satellite signal and second satellite signal reception; and a leap second correction unit that corrects the current leap second based on the first leap second value or the second leap second value when the first leap second value and the second leap second value satisfy the set evaluation condition.

The electronic timepiece in this aspect of the invention receives at least two satellite signals, a first satellite signal containing a first leap second value and a second satellite signal containing a second leap second value, with a receiver unit. Note that the first and second leap second values are information denoting the current leap second value contained in the satellite signal. The first and second satellite signals may be received substantially simultaneously from plural satellites, or at different times from one or a plurality of satellites.

The correctness and reliability of the received leap second value can be evaluated based on whether or not the first and second leap second values contained in the received satellite signals meet the condition set by the evaluation condition setting unit. More particularly, the correctness of the leap second value can be accurately determined because the evaluation is based on two leap second values instead of just one. Therefore, the leap second correction unit can accurately determine that the correct leap second value was acquired when the condition is met, and can correctly adjust the current leap second using the acquired first or second leap second value. Note that because the first and second leap second values determined to be correct are normally the same value, the current leap second can be updated using either the first or the second leap second value.

The evaluation condition setting unit also sets the evaluation condition based on the timing of first and second satellite signal reception. Therefore, when the reception environment is good and plural satellite signals can be received substantially simultaneously, the correctness of the leap second value can be determined by setting a condition for when the first and second leap second value are acquired substantially simultaneously. When the reception environment is not particularly good and only one satellite signal can be received, the correctness of the leap second value can be determined by setting the condition for when the first and second leap second value are acquired at different times. Because the evaluation condition is selected based on the timing of first and second satellite signal reception, evaluation is possible using the evaluation condition appropriate to the reception environment, and the correctness of the leap second value can be determined with a high degree of accuracy.

An electronic timepiece according to another aspect of the invention preferably also has a candidate leap second value storage unit that stores first leap second value contained in the first satellite signal as candidate leap second value. The receiver unit receives the second satellite signal after receiving the first satellite signal; and the evaluation condition setting unit sets as the evaluation condition that the second satellite signal is received from a positioning information satellite in normal satellite health condition, and the second leap second value and the candidate leap second value are the same.

This aspect of the invention stores the first leap second value contained in the first satellite signal as candidate leap second value, and determines if the previously received candidate leap second value (first leap second value) and the second leap second value are the same. Because this aspect of the invention can evaluate two leap second values received at different times even when the second satellite signal can only be received from one satellite because the reception environment is poor, the correctness of the leap second value can be accurately determined. The correctness of the received leap second value can therefore be determined more accurately than when the correctness of the leap second value is determined by a parity check.

In another aspect of the invention, the receiver unit receives the first satellite signal and the second satellite signal in one reception process; and the evaluation condition setting unit sets as the evaluation condition that the first leap second value and the second leap second value are the same.

This aspect of the invention can accurately determine the correctness of the leap second value by determining whether or not the first and second leap second values are the same when satellite signals are received from a plurality of satellites in one reception process. The correctness of the received leap second value can therefore be determined more accurately than when the correctness of the leap second value is determined by a parity check. In addition, because evaluation is possible with one reception process, the reception time can be shortened and power consumption reduced compared with receiving the leap second value at different times.

An electronic timepiece according to another aspect of the invention preferably also has a candidate leap second value storage unit that stores first leap second value contained in the first satellite signal as candidate leap second value. The receiver unit receives the first satellite signal and the second satellite signal. The evaluation condition setting unit sets as the evaluation condition that the second satellite signal was received from a positioning information satellite in normal satellite health, and the second leap second value and the candidate leap second value are the same, when the second satellite signal is received from one positioning information satellite after receiving the first satellite signal and storing the first leap second value as the candidate leap second value in the candidate leap second value storage unit; and sets as the evaluation condition that the first leap second value and the second leap second value are the same when the first satellite signal and second satellite signal are received in one reception process.

When the first satellite signal and second satellite signal are received at different times (in different reception processes), the first leap second value that was received first is stored in memory as candidate leap second value, and the second leap second value received thereafter is compared with the candidate leap second value (first leap second value) to determine if they are the same. Because this aspect of the invention can evaluate two leap second values received at different times even when the second satellite signal can only be received from one satellite because the reception environment is poor, the correctness of the leap second value can be accurately determined.

This aspect of the invention can also accurately determine the correctness of the leap second value by determining whether or not the first and second leap second values are the same when satellite signals are received from a plurality of satellites in one reception process.

Because the evaluation condition can thus be selected when the second satellite signal is received based on whether plural satellite signals were received or only one satellite signal was received, whether or not accurate leap second value was received can be accurately determined.

The correctness of the received leap second value can therefore be determined more accurately than when the correctness of the leap second value is determined by a parity check.

Further preferably, an electronic timepiece according to another aspect of the invention has a candidate leap second value updating unit that updates the candidate leap second value to the second leap second value when the second leap second value and the candidate leap second value are not the same.

When the candidate leap second value and the second leap second value are not the same, one or both may be incorrect data due to noise, for example. As a result, if the candidate leap second value is not updated, the second leap second value may be repeatedly received when the candidate leap second value is wrong and a data mismatch may continue.

This aspect of the invention can update the candidate leap second value to the most recent leap second value because the candidate leap second value is updated with the currently received second leap second value. As a result, the possibility of a match with the candidate leap second value can be improved when the leap second value is received next, and the correctness of the leap second value can be accurately determined.

In another aspect of the invention, the evaluation condition setting unit additionally sets in the evaluation condition that the satellite signal containing the leap second value was received from a positioning information satellite in normal satellite health.

This aspect of the invention adds the requirement that reception was from a positioning information satellite in a normal satellite health state to the other evaluation conditions. Because the invention determines if two leap second values are the same, the possibility of updating the current leap second value with an incorrect leap second value is low because the leap second value will normally not be the same even if the leap second value is received from a satellite that is not healthy. However, if plural leap second values are received from a satellite that is not healthy, there is a very slight possibility that the values will be the same.

However, because the invention does not use a satellite signal (leap second value) received from a satellite that is not healthy, the correctness of the leap second value can be determined even more accurately.

Further preferably in another aspect of the invention, the receiver unit receives a satellite signal containing the leap second value and future leap second value; and the evaluation condition setting unit additionally sets in the evaluation condition that the difference between the leap second value contained in the satellite signal and the future leap second value is greater than or equal to −1 second and less than or equal to +1 second.

When a leap second event is scheduled, the future leap second value contained in the satellite signal is set to a new value.

As a result, the current leap second value contained in the satellite signal and the future leap second value will be different. The future leap second value will be changed −1 second or +1 second from the current leap second, and will never be changed ±2 seconds or more. As a result, if the first and second leap second values (current leap second value) received are the same, but the difference to the future leap second value that was received is outside the range of greater than or equal to −1 second and less than or equal to +1 second, the leap second value that was received may be incorrect. As a result, by adding this evaluation condition, the correctness of the leap second value can be determined even more accurately.

Furthermore, when a leap second event is not scheduled, the current leap second value contained in the satellite signal and the future leap second value will be the same values and the difference therebetween will be 0 second, that is, within the range of greater than or equal to −1 second and less than or equal to +1 second, matching this condition.

Further preferably, this condition is applied when the first satellite signal is received and when the second satellite signal is received because the accuracy of determining the correctness of the leap second value can be improved.

In another aspect of the invention, the receiver unit receives a satellite signal containing the leap second value, future leap second value, and a scheduled leap second event; and the evaluation condition setting unit additionally sets in the evaluation condition that the scheduled leap second event is after the date the satellite signal was received when the leap second value contained in the satellite signal and the future leap second value are different values.

When a leap second event is scheduled, the future leap second value contained in the satellite signal is set to a new value. As a result, the current leap second value contained in the satellite signal and the future leap second value will be different. In this event, the date of the scheduled leap second event will be a date after the reception date.

Therefore, when these conditions are not met, the leap second value that was received, the future leap second value, or the scheduled date of the leap second event may be incorrect. As a result, by adding this evaluation condition, the correctness of the leap second value can be determined even more accurately.

Further preferably, this condition is applied when the first satellite signal is received and when the second satellite signal is received because the accuracy of determining the correctness of the leap second value can be improved.

An electronic timepiece according to another aspect of the invention has a timekeeping unit that keeps time according to the current leap second; a receiver unit that receives a first satellite signal in a first reception process, and receives a second satellite signal after the first satellite signal in a second reception process that is different from the first; candidate leap second value storage unit that stores first leap second value contained in the first satellite signal as candidate leap second value; and a leap second correction unit that corrects the current leap second based on at least one of the second leap second value and the candidate leap second value when the second leap second value contained in the second satellite signal is the same as the candidate leap second value.

This aspect of the invention stores the first leap second value contained in the first satellite signal as candidate leap second value, and determines if the previously received candidate leap second value (first leap second value) and the second leap second value are the same. Because this aspect of the invention can evaluate two leap second values received at different times even when the second satellite signal can only be received from one satellite because the reception environment is poor, the correctness of the leap second value can be accurately determined. The correctness of the received leap second value can therefore be determined more accurately than when the correctness of the leap second value is determined by a parity check.

Another aspect of the invention is a reception control method of an electronic timepiece having a receiver unit that receives satellite signals, and a timekeeping unit that keeps time according to the current leap second, the control method including: receiving a first satellite signal containing a first leap second value and a second satellite signal containing a second leap second value; setting an evaluation condition of the correctness of the first leap second value and the second leap second value based on the timing of first satellite signal and second satellite signal reception; and correcting the current leap second based on the first leap second value or the second leap second value when the first leap second value and the second leap second value satisfy the set evaluation condition.

This aspect of the invention has the same effects as the electronic timepiece of the invention. More specifically, because the evaluation condition is set based on the timing of first and second satellite signal reception, when the reception environment is good and plural satellite signals can be received simultaneously, the correctness of the leap second value can be determined by setting a condition for when the first and second leap second value are acquired simultaneously. When the reception environment is not particularly good and only one satellite signal can be received, the correctness of the leap second value can be determined by setting the condition for when the first and second leap second value are acquired at different times. Because the evaluation condition is selected based on the timing of first and second satellite signal reception, evaluation is possible using the evaluation condition appropriate to the reception environment, and the correctness of the leap second value can be determined with a high degree of accuracy.

Another aspect of the invention is a reception control method of an electronic timepiece having a receiver unit that receives satellite signals, a timekeeping unit that keeps time according to the current leap second, and a candidate leap second value storage unit, the control method including: receiving a first satellite signal containing a first leap second value; storing the first leap second value as candidate leap second value in the candidate leap second value storage unit; receiving a second satellite signal containing a second leap second value; determining if the second leap second value contained in the second satellite signal and the candidate leap second value are the same; and correcting the current leap second based on at least one of the second leap second value and the candidate leap second value when the second leap second value is the same as the candidate leap second value.

This aspect of the invention also has the same effects as the electronic timepiece of the invention. More specifically, by determining if the previously received candidate leap second value (first leap second value) and the second leap second value are the same, this aspect of the invention can accurately determine the correctness of the leap second value even when the second satellite signal can only be received from one satellite because the reception environment is poor. The correctness of the received leap second value can therefore be determined more accurately than when the correctness of the leap second value is determined by a parity check.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

Figure 1:
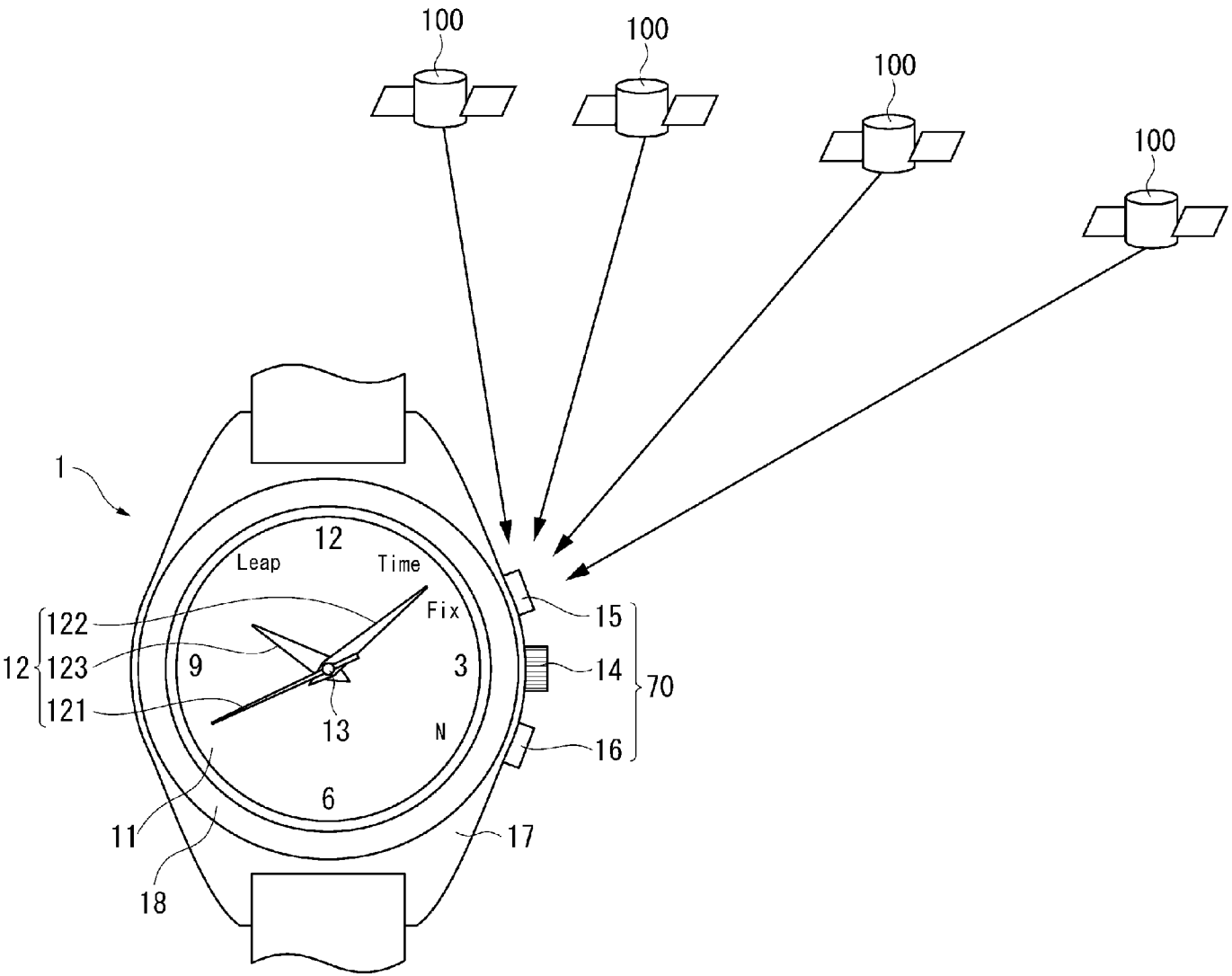
FIG. 1 is a plan view showing an electronic timepiece according to the invention.
Figure 2:
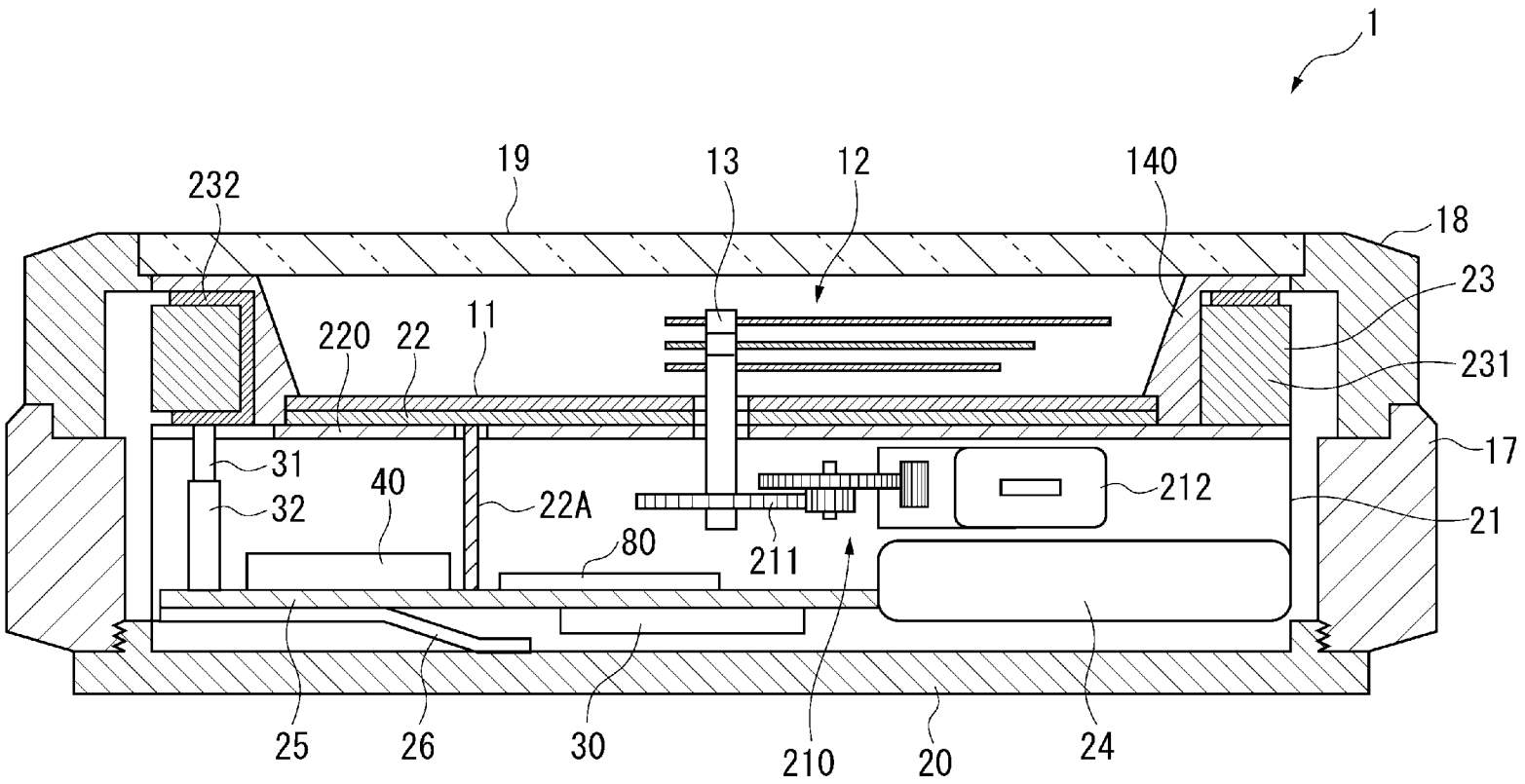
FIG. 2 is a schematic section view of the electronic timepiece.

FIG. 1 is a plan view of an electronic timepiece 1 according to the first embodiment of the invention, and FIG. 2 is a section view of the electronic timepiece 1.

As shown in FIG. 1, from a constellation of multiple GPS satellites 100 (positioning information satellites) orbiting the Earth on specific known orbits, the electronic timepiece 1 receives satellite signals and acquires time information from at least one GPS satellite 100, and receives satellite signals from at least three GPS satellites 100 to calculate the current position.

Note that a GPS satellite 100 is an example of a positioning information satellite, and there are multiple positioning information satellites in orbit. There are currently approximately 30 GPS satellites 100 in orbit.

Electronic Timepiece

The electronic timepiece 1 is a wristwatch that is worn on the user's wrist, has a dial 11 and hands 12 (time display unit), and keeps and displays the time.

The greater part of the dial 11 is made from a non-metallic material, such as plastic or glass, that is transparent to light and microwaves in the 1.5 GHz band.

The hands 12 are disposed on the exposed face side of the dial 11. The hands 12 include a second hand 121, minute hand 122, and hour hand 123 that rotate on a center pivot 13, and are driven by a stepper motor through a wheel train.

Operation of Operating Members

The electronic timepiece 1 executes specific processes according to manual operation of external operating members 70 (operating units) including a crown 14 and pushers 15, 16.

More specifically, if the crown 14 is operated, a time correction process that adjusts the displayed time according operation of the crown 14 is executed. If the one pusher 15 is pressed for a long time (such as 3 seconds or more), a manual reception process (unconditional reception process) for receiving satellite signals is executed.

If the other pusher 16 is pressed, a selection process that changes the reception mode (timekeeping mode, positioning mode, leap second reception mode) is executed.

The timekeeping mode is a mode for locking onto one or more GPS satellites 100 and receiving satellite signals, and acquiring time information from the received satellite signals.

The positioning mode is a mode for locking onto and receiving satellite signals from three or more GPS satellites 100, and acquiring positioning information by calculating the current position based on the received satellite signals. Note that time information is normally also received from the satellite signals at the same time in the positioning mode. However, not acquiring the time information from the satellite signals in the positioning mode is also possible.

The leap second reception mode is a mode for locking onto and receiving satellite signals from one or more GPS satellites 100, and acquiring the leap second value that is transmitted at a specific interval (every 12.5 minutes in a GPS satellite signal). Note that time information is simultaneously acquired from the satellite signal in the leap second reception mode.

The reception mode set by operating the pusher 16 is stored in the reception mode storage unit 660 of the memory device 60 described below. If the timekeeping mode is selected, the second hand 121 jumps to the TIME position (at the 5 second position), and if the positioning mode is selected, the second hand 121 jumps to the FIX position (at the 10 second position). If the leap second reception mode is selected, the second hand 121 jumps to the LEAP (leap second) position (at the 55 second position). The user can therefore easily know which mode is set.

Note that indicating the reception mode is not limited to using the second hand 121, and a separate hand (mode hand) that displays the reception mode could be separately provided.

In the scheduled reception process described below, the reception mode may be fixed to the timekeeping mode or the positioning mode irrespective of the mode set by the pusher 16, or the reception mode set with the pusher 16 could be used in the scheduled reception mode. As described below, operation is fixed to the timekeeping mode during the scheduled reception process in this embodiment.

If pusher 15 is pressed for a short time (such as less than 3 seconds), a result display process that displays the result of the last reception process is executed. More specifically, if reception is successful in the positioning mode, the second hand 121 goes to the FIX (10 second position) position; if reception is successful in the timekeeping mode, the second hand 121 goes to the TIME (5 second position) position; and if reception is successful in the leap second reception mode, the secondhand 121 goes to the LEAP (55 second position). If reception fails, the second hand 121 goes to the N position (20 second position).

These indications are also made by the second hand 121 during reception. More specifically, during reception in the positioning mode, the second hand 121 goes to the FIX (10 second position) position; during reception in the timekeeping mode, the second hand 121 goes to the TIME (5 second position) position; and if reception is successful in the leap second reception mode, the second hand 121 goes to the LEAP (55 second position). If a GPS satellite 100 cannot be locked onto, the second hand 121 goes to the N position (20 second position).

Construction of an Electronic Timepiece

As shown in FIG. 2, the electronic timepiece 1 has a case 17 made of stainless steel (SUS), titanium, or other metal. The case 17 is substantially cylindrical. A crystal 19 is attached over the opening on the face side of the case 17 with a bezel 18. The bezel 18 is made of ceramic or other non-metallic material to improve satellite signal reception performance. A back cover 20 is attached to the opening on the back side of the case 17.

A dial 11, movement 21, solar panel 22, GPS antenna 23, and storage battery 24 are disposed inside the case 17.

The movement 21 includes a drive mechanism 210 that drives the hands 12. The drive mechanism 210 includes a stepper motor, wheel train 211, and a drive circuit that drives the stepper motor. The stepper motor includes a motor coil 212, stator, and rotor, and drives the hands 12 through the wheel train 211 and center pivot 13.

A circuit board 25 is disposed on the back cover 20 side of the movement 21.

Disposed to the circuit board 25 are a receiver device 30 that processes satellite signals received through the GPS antenna 23, a control device 40 that controls the receiver device 30 and driving the stepper motor, and a charging circuit 80 that charges the storage battery 24 with power produced by the solar panel 22. The receiver device 30 and control device 40 are driven by power supplied from the storage battery 24.

Solar Panel

The solar panel 22 is a photovoltaic device that produces power by converting light energy to electrical energy. The solar panel 22 includes 7 or 8 solar cells not shown, and the solar cells are connected in series and output.

As shown in FIG. 2, the solar panel 22 is supported by a solar panel support substrate 220. The solar panel support substrate 220 is a conductive plate approximately 0.1 mm thick, and made of metal such as brass, stainless steel (SUS), or titanium alloy. As a result, the solar panel support substrate 220 has the same current distribution as the GPS antenna 23 disposed nearby, and functions as part of the GPS antenna 23.

The solar panel support substrate 220 is installed so that it does not contact the case 17. More specifically, the solar panel support substrate 220 is disposed so that its outside edge is separated from and does not contact the inside surface of the case 17.

The solar panel support substrate 220 cannot be seen from the outside because the outside diameters of the dial 11 and solar panel 22 are determined according to the inside diameter of the dial ring 140, and their outside edges are hidden by the dial ring 140. The outside dimension of the solar panel support substrate 220 also exceeds the size of the solar panel 22 and dial 11, and the solar panel support substrate 220 extends to below the GPS antenna 23.

GPS Antenna

The GPS antenna 23 is a ring antenna including a ring-shaped dielectric base 231 that is rectangular in section, and an antenna electrode 232 formed on the surface of the dielectric base 231.

The dielectric base 231 shortens the wavelength of the radio waves, and may be made of materials such as a ceramic of primarily alumina ($\Sigma r$=8.5), a ceramic of primarily mica such as Mycalex® ($\Sigma r$=6.5-9.5), glass ($\Sigma r$=5.4-9.9), or diamond ($\Sigma r$=5.68).

The antenna electrode 232 is formed as a line in unison with the dielectric base 231 by printing a copper, silver, or other conductive metal material on the surface of the dielectric base 231, or bonding a silver, copper, or other conductive metal plate to the surface of the dielectric base 231. The antenna electrode 232 may also be formed by an electroless plating pattern on the surface of the dielectric base 231.

A connector pin 31 contacts the antenna electrode 232. The connector pin 31 is inserted to a substantially tubular connector base 32. The connector base 32 rises vertically and is connected to a printed wiring line on the circuit board 25.

The connector pin 31 and connector base 32 are electrically connected through the printed line to the receiver device 30. The connector base 32 has an urging member such as a coil spring inside the tube part, and urges the connector pin 31 inserted to the connector base 32 to the antenna electrode 232 side. The connector pin 31 is thereby pressed against the feed node of the antenna electrode 232, and the connection between the connector pin 31 and antenna electrode 232 is maintained even when the electronic timepiece 1 is subject to impact shock.

The conductive back cover 20 also functions as the ground plane (reflector) of the GPS antenna 23 in this embodiment of the invention. The back cover 20 is conductive to a ground terminal 26 disposed to the movement 21. The ground terminal 26 connects to the ground potential of the receiver device 30 of the movement 21. The back cover 20 is therefore electrically connected to the ground potential of the receiver device 30 through the ground terminal 26, and functions as a ground plane (reflector) that reflect radio waves incident from the crystal 19 side to the GPS antenna 23. Because the conductive case 17 in contact with the back cover 20 also goes to ground, the case 17 also functions as a ground plane.

In addition to functioning as a ground plane, the back cover 20 and case 17 are metal and therefore also prevent adverse effects on the GPS antenna 23 when the electronic timepiece 1 is worn on the user's wrist. More specifically, if the case is a plastic case, the resonance frequency of the GPS antenna 23 is affected by the user's arm and differs depending on whether or not the electronic timepiece 1 is being worn, and performance varies undesirably. However, because the case is metal in this embodiment, effects from the body can be avoided by the shield effect of the case, there is substantially no difference in antenna characteristics when the electronic timepiece 1 is being worn and not worn, and stable reception process can be achieved. However, a plastic case could be used instead.

Storage Battery

The storage battery 24 is the power supply device of the electronic timepiece 1, and stores power generated by the solar panel 22.

Two electrodes of the solar panel 22 and two electrodes of the storage battery 24 can be electrically connected to each other by two conductive coil springs 22A, and when thus connected the storage battery 24 can be charged by the power generated by the solar panel 22 of the electronic timepiece 1.

A lithium ion storage battery that is suitable for mobile devices is used as the storage battery 24 in this embodiment of the invention, but a lithium polymer battery or other type of storage battery can be used. A storage device other than a storage battery (such as a capacitive device) can also be used.

Electronic Timepiece Circuits

Figure 3:
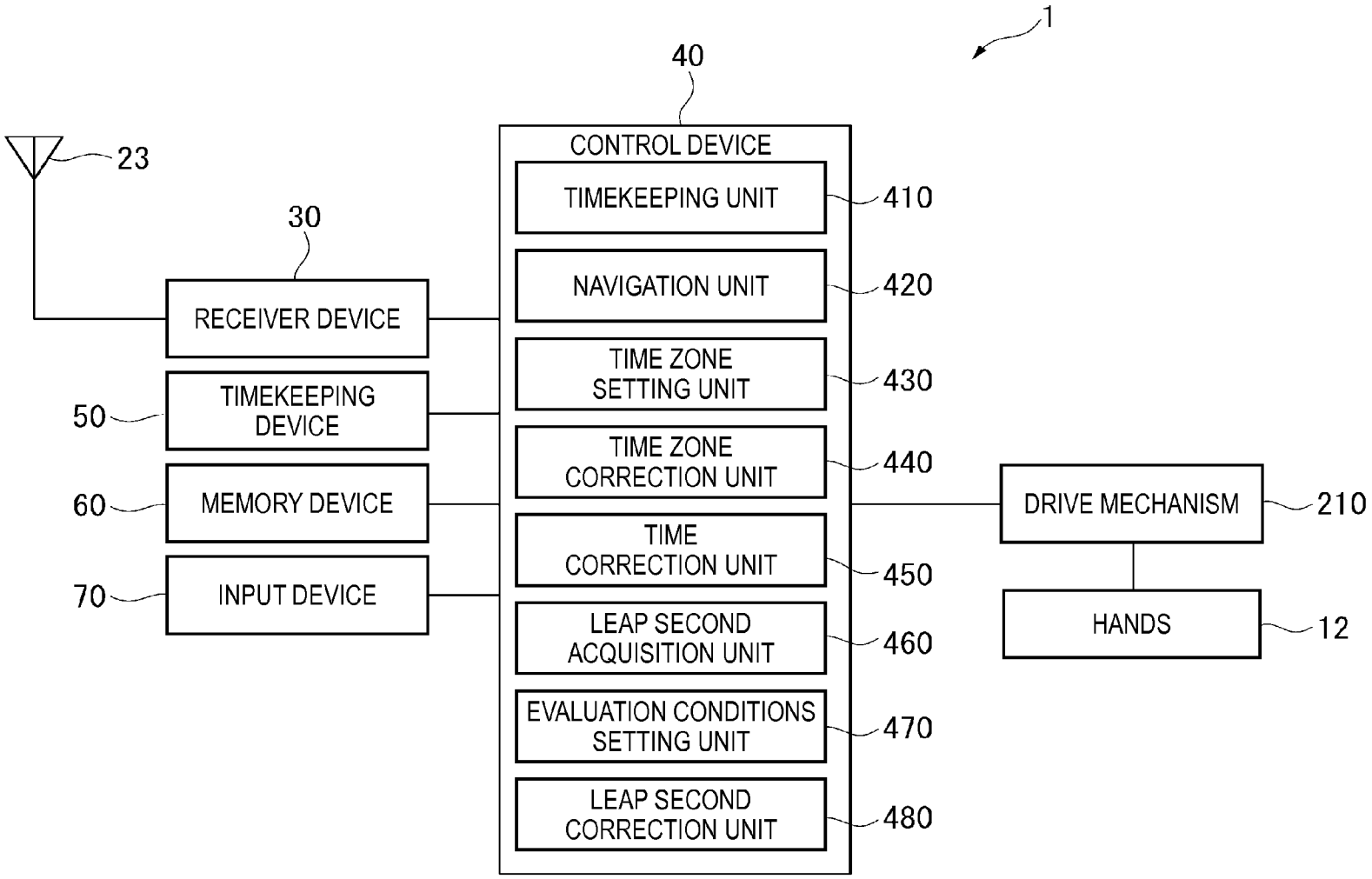
FIG. 3 is a block diagram showing the configuration of the electronic timepiece.

FIG. 3 is a block diagram showing the configuration of the electronic timepiece 1. The electronic timepiece 1 includes a receiver device 30 (reception unit), control device 40 (control unit), timekeeping unit 50 (timekeeping unit), memory device 60 (storage unit) and input device 70 (operating unit).

Receiver Device

The receiver device 30 is a load driven by power stored in the storage battery 24, and when driven by the control device 40, receives satellite signals transmitted from a GPS satellite 100 through the GPS antenna 23. When satellite signal reception is successful, the receiver device 30 sends the acquired orbit information, GPS time information, and other information to the control device 40. When satellite signal reception fails, the receiver device 30 sends a reception failure report to the control device 40. The configuration of the receiver device 30 is the same as a GPS reception circuit known from the literature, and further description thereof is thus omitted.

Navigation Message

The format of a navigation message contained in the satellite signals received by the receiver device 30 is described next with reference to FIG. 4A to FIG. 4C.

Figure 4A:
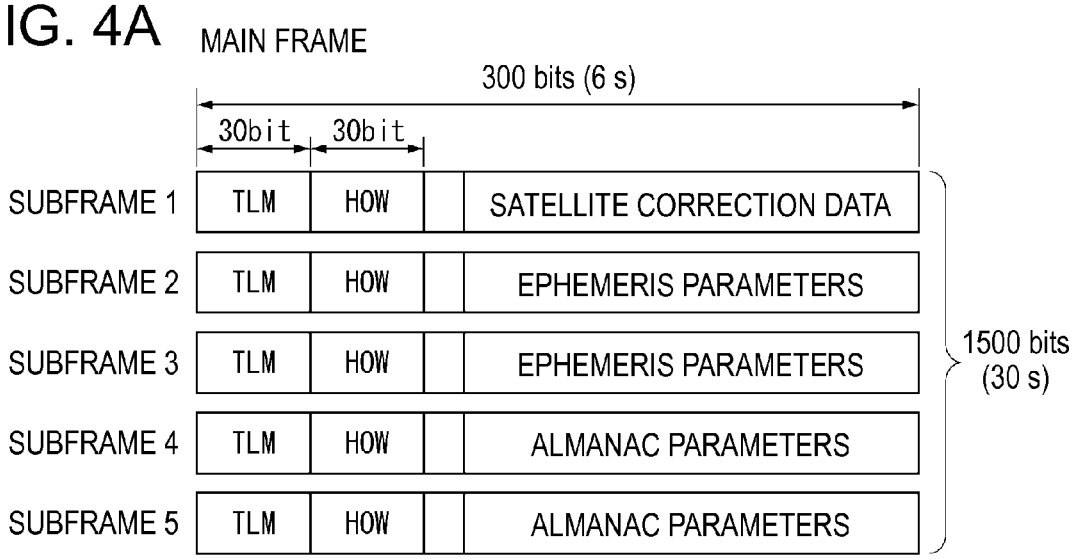
FIG. 4A describes the structure of a navigation message.

As shown in FIG. 4A, a navigation message is composed of main frame units each containing 1500 bits. Each main frame is divided into five subframes 1 to 5 of 300 bits each. The data in one subframe is transmitted in 6 seconds from a GPS satellite 100. It therefore takes 30 seconds for a GPS satellite 100 to transmit the data in one main frame.

Figure 5:
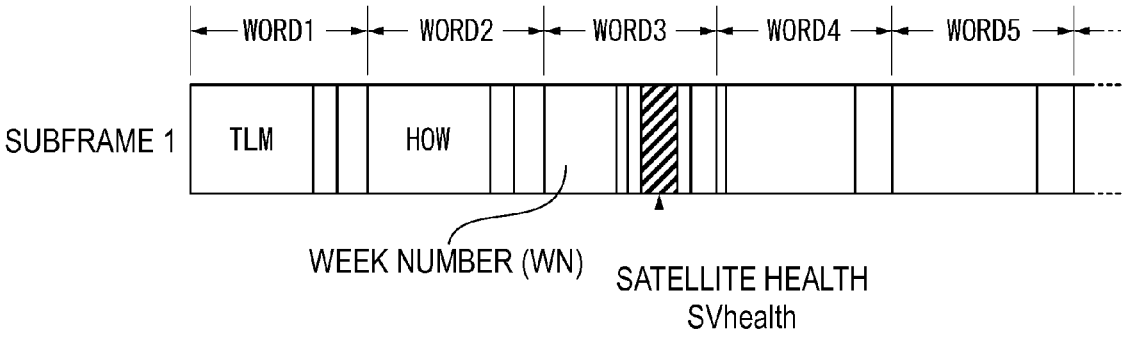
FIG. 5 describes the structure of subframe 1.

As shown in FIG. 5, subframe 1 contains satellite correction data including the week number (WN) and satellite health information (SV health). The week number identifies the week to which the current GPS time information belongs. More specifically, GPS time started at 00:00:00 on Jan. 6, 1980 in UTC (Coordinated Universal Time), and the week number of the week that started that day is week number 0. The week number is updated every week.

The satellite health information (SVhealth) is a code indicating if an error has occurred in the satellite, and this code can be used to prevent using signals transmitted from satellites in which there is an error. More specifically, the navigation message is normal if the satellite health SVhealth bit is set to 0, and there is a problem with part or all of the navigation message if the satellite health SVhealth bit is set to 1.

Because subframes 1 to 3 in each set of five subframes contains information specific to a particular satellite, the same content is repeated during every transmission. More specifically, subframes 1 to 3 contain clock correction data and orbit information (ephemeris) specific to the transmitting satellite. Subframes 4 and 5, however, contain orbit information for all satellites (almanac data) and ionospheric correction information, which are stored in subframes 4 and 5 over multiple pages because of the large amount of information.

More specifically, the data carried in subframes 4 and 5 is divided over pages 1 to 25, and different page content is sequentially transmitted in each frame. Because 25 frames are required to transmit the content of all pages, 12 minutes 30 seconds is required to receive all of the information in the navigation message.

Each of subframes 1 to 5 starts with a telemetry (TLM) word storing 30 bits of telemetry data followed by a HOW word (handover word) storing 30 bits of handover data.

Therefore, while the TLM and HOW words are transmitted at 6-second intervals from the GPS satellites 100, the week number data and other satellite correction data, ephemeris, and almanac data are transmitted at 30-second intervals.

Figure 4B:
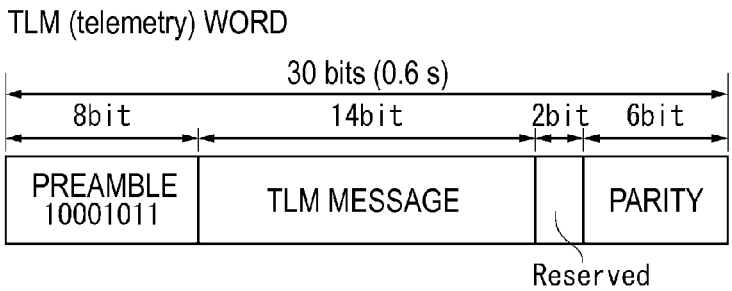
FIG. 4B describes the TLM (telemetry) word portion of a subframe of a navigation message.

As shown in FIG. 4B, the TLM word contains a preamble, a TLM message and reserved bits, and parity data.

Figure 4C:
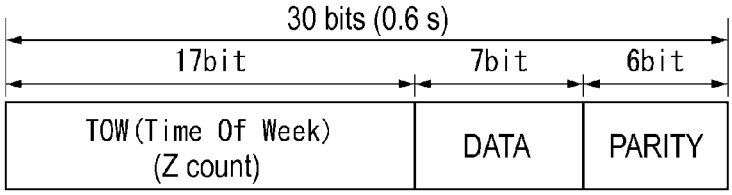
FIG. 4C describes the HOW (handover) word portion of a subframe of a navigation message.

As shown in FIG. 4C, the HOW word contains GPS time information called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted. For example, the Z count transmitted in subframe 1 denotes the GPS time that the first bit in subframe 2 is transmitted. The HOW word also contains 3 bits of data denoting the subframe ID (ID code).

leap second value is contained in page 18 of subframe 4. More specifically, data related to the leap second, that is, the current leap second value $\Delta t_{LS}$, the week number of the leap second event $WN_{LSF}$, the day number of the leap second event DN, and the future leap second value $\Delta t_{LSF}$, is stored on page 18 in subframe 4 of the satellite signal. Of these values, the current leap second value $\Delta t_{LS}$ is referred to as the leap second value in this embodiment of the invention.

The week number of the leap second event, the day number of the leap second event, and the future leap second value are required to execute the next leap second event process. These values are updated to the new values from approximately six months before the next leap second event. As a result, the data remains even after the leap second event. As a result, the current leap second value $\Delta t_{LS}$ and the future leap second value $\Delta t_{LSF}$ are the same until the next leap second event. Therefore, a leap second event has not been scheduled if $\Delta t_{LS}$ and $\Delta t_{LSF}$ are the same, and if the values are different, a leap second event has been scheduled.

The time information (Z count) is stored in all subframes, and can therefore be received as every 6 seconds.

This means that when the calendar is not set, such as after a system reset, subframe 1 transmitted every 30 seconds must be received, the week number and satellite health information acquired, and the year, month, day values determined.

In order to calculate UTC from GPS time, which can be calculated from the week number and Z count, subframe 4 on page 18 transmitted every 12.5 minutes must be received, and the current leap second value acquired.

Furthermore, because the amount of time past from when the week number was received can be counted after the week number and current leap second have been acquired, the current week number of the GPS satellite can be known from the acquired week number and the elapsed time without receiving the week number again. Therefore, once the Z count has been acquired, the current GPS time can be acquired and the time adjusted using the current leap second value, and UTC can be determined.

Timekeeping Unit

The timekeeping unit 50 includes a crystal oscillator that is driven by power stored in the storage battery 24, and updates the time using a reference signal based on the oscillation signal from the crystal oscillator.

Memory Device

Figure 6:
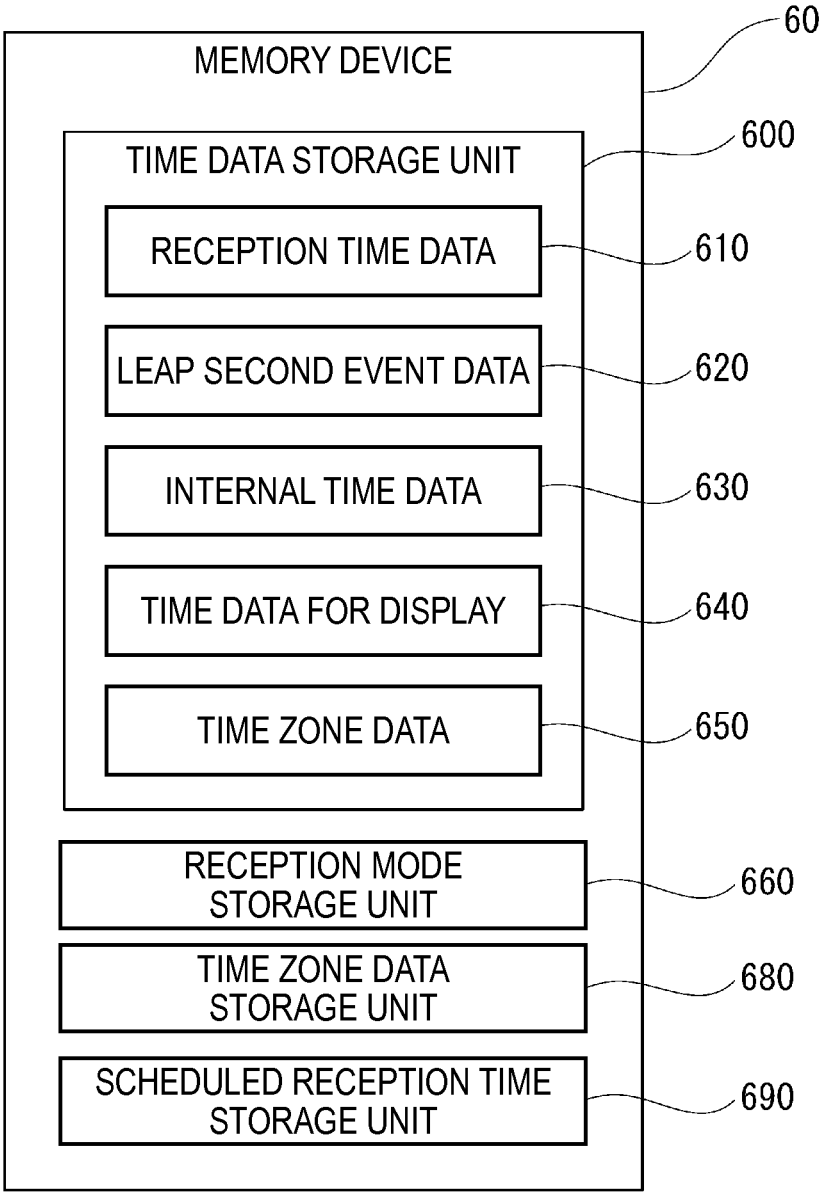
FIG. 6 is a block diagram showing the configuration of the memory device.

As shown in FIG. 6, the memory device 60 includes a time data storage unit 600, a reception mode storage unit 660, a time zone data storage unit 680, and a scheduled reception time storage unit 690.

The time data storage unit 600 stores the reception time data 610, leap second event data 620, internal time data 630, time data for display 640, and time zone data 650.

Time information acquired from a satellite signal (GPS time information) is stored in the reception time data 610. This reception time data 610 is normally updated every second by the timekeeping unit 50, and is adjusted according to the acquired time information (GPS time) when a satellite signal is received.

At least the current leap second data is stored in the leap second event data 620. When the week number of the leap second event, day number of the leap second event, and the future leap second values are acquired, these values are also stored in the leap second event data 620.

Because the current leap second $\Delta t_{LS}$ is the leap second value used by the invention, the time data storage unit 600 that stores the leap second event data 620 also functions as the leap second storage unit of the invention.

The internal time is stored in the internal time data 630. The internal time is updated based on the GPS time stored in the reception time data 610, and the current leap second (leap second value) stored in the leap second event data 620.

UTC is thus stored in the internal time data 630. This internal time information is also updated when the reception time data 610 is updated by the timekeeping unit 50.

The time obtained by applying the time zone data (time zone information, time difference information) stored in the time zone data 650 to the internal time information in the internal time data 630 is stored as the time data for display 640. The time zone data 650 is set by the positioning information (location information) acquired when signals are received in the positioning mode.

The reception mode storage unit 660 stores the reception mode set by operating a pusher 16 as described above.

The time zone data storage unit 680 stores positioning information (latitude and longitude) linked to the time zone information (time difference information). As a result, when positioning information is acquired in the positioning mode, the control device 40 can acquire the time zone based on the positioning information (latitude and longitude).

Note that city names linked to time zone data can also be stored in the time zone data storage unit 680. In this event, if the user selects a city for which the current local time is desired by operating the input device 70, the control device 40 searches the time zone data storage unit 680 for the city name selected by the user, acquires the time zone linked to that city name, and saves the time zone in the time zone data 650.

The scheduled reception time at which the timekeeping unit 410 runs the scheduled reception process is stored in the scheduled reception time storage unit 690. The time when reception initiated by manually operating the pusher 15 was last successful is stored as the scheduled reception time.

Control Device

The control device 40 is embodied by the CPU that controls the electronic timepiece 1. The control device 40 includes a timekeeping unit 410, navigation unit 420, time zone setting unit 430, time zone correction unit 440, time correction unit 450, leap second acquisition unit 460, evaluation conditions setting unit 470, and leap second correction unit 480.

Timekeeping Unit

The timekeeping unit 410 operates the receiver device 30 to execute the reception process in the timekeeping mode. This embodiment executes the reception process in the timekeeping means by means of an automatic reception process or a manual reception process.

The automatic reception process includes a scheduled reception process and a light-based automatic reception process. More specifically, the timekeeping unit 410 operates the receiver device 30 and executes the scheduled reception process of the timekeeping mode when the internal time data for display 640 reaches the scheduled reception time stored in the scheduled reception time storage unit 690.

When the output voltage or output current of the solar panel 22 reaches a preset level and the electronic timepiece 1 can be determined to be outdoors where the solar panel 22 is exposed to daylight, the timekeeping unit 410 operates the receiver device 30 and executes the light-based automatic reception process of the timekeeping mode. Note that the number of times the receiver device 30 executes a process based on the power output state of the solar panel 22 can be limited to once a day, for example.

When set to the timekeeping mode and the user presses the pusher 15 of the input device 70 to start the reception process manually, the timekeeping unit 410 operates the receiver device 30 and executes the manual reception process of the timekeeping mode.

The timekeeping unit 410 then locks onto at least one GPS satellite 100 with the receiver device 30, receives satellite signals transmitted from that GPS satellite 100, and acquires the time information.

Navigation Unit

When set to the positioning mode and the user presses the pusher 15 of the input device 70 to start reception manually, the navigation unit 420 operates the receiver device 30 and executes the reception process in the positioning mode.

Note that the control device 40 could switch between the reception process in the timekeeping mode using the timekeeping unit 410, and the reception process in the positioning mode using the navigation unit 420, according to how long the pusher 15 is held depressed irrespective of the reception mode stored in the reception mode storage unit 660. For example, the control device 40 could execute the reception process in the timekeeping mode when the pusher 15 is pressed for a first set time (3 seconds or more and less than 6 seconds), and execute the reception process in the positioning mode when pressed for a second set time (6 seconds or longer).

When the reception process starts in the positioning mode, the navigation unit 420 locks onto at least three and preferably four or more GPS satellites 100 with the receiver device 30, receives the satellite signals transmitted from the GPS satellites 100, and calculates the current position. The navigation unit 420 can acquire time information at the same time when receiving the satellite signals.

Time Zone Setting Unit

When positioning information is successfully acquired by the navigation unit 420, the time zone setting unit 430 sets the time zone based on the acquired positioning information (latitude and longitude). More specifically, the time zone setting unit 430 selectively acquires and saves the time zone data corresponding to the positioning information (time zone information, that is, time difference information) from the time zone data storage unit 680 to the time zone data 650.

For example, because Japan Standard time (JST) is 9 hours ahead of UTC (UTC+9), when the positioning information acquired by the navigation unit 420 is for a location in Japan, the time zone setting unit 430 reads the time difference (+9 hours) for JST from the time zone data storage unit 680 and saves the time difference in the time zone data 650.

Time Zone Correction Unit

When the time zone setting unit 430 sets the time zone information, the time zone correction unit 440 corrects the time data for display 640 based on the time zone data. As a result, the time data for display 640 reflects the internal time data 630 (UTC) plus the time zone difference.

Time Correction Unit

When time information is successfully acquired in the reception process of the timekeeping unit 410 or navigation unit 420, the time correction unit 450 corrects the reception time data 610 based on the acquired time information. As a result, the internal time data 630 and time data for display 640 are also corrected. When the time data for display 640 is corrected, the time displayed by the hands 12 synchronized to the time data for display 640 is also corrected by the hand position detection means.

Leap Second Acquisition Unit

The leap second acquisition unit 460 operates the receiver device 30 and executes the reception process of the leap second reception mode. The leap second acquisition unit 460 receives the leap second value when the leap second reception mode is set by the pusher 16 and the manual reception mode is started by the pusher 15. The leap second value is received when the timekeeping unit 410 or navigation unit 420 executes the reception process at the preset leap second reception time.

The leap second reception time is set every half year in this embodiment of the invention. More specifically, the leap second is currently updated at least every half year, and in recent years has been updated once every year or several years. More specifically, a leap second event occurs on the last day of December or June. The leap second value also contains information about the next leap second event and the future leap second value.

As a result, whether or not a leap second event is scheduled within the next half year can be determined by receiving the leap second value every half year (specifically, in June and December).

Therefore, if the current month and day of the internal time is June 1 to 30 or December 1 to 31, and receiving the leap second during that period has not succeeded, the leap second acquisition unit 460 determines that it is time to receive the leap second value, and executes the leap second value acquisition process when the timekeeping unit 410 or navigation unit 420 executes the reception process. If leap second reception during the leap second reception period is successful, the leap second value is not received again for the remainder of that half year unless the leap second reception mode is set manually.

Note that because the leap second reception period is a half year period including the day number of the leap second event, the leap second reception period is not limited to June and December, and could be July and January, or August and February, for example.

The leap second acquisition unit 460 locks onto at least one GPS satellite 100 with the receiver device 30, receives the satellite signals transmitted from that GPS satellite 100, and acquires the leap second value. As described above, the leap second value is stored in page 18 of subframe 4, and is therefore transmitted every 12.5 minutes.

As a result, when the leap second acquisition unit 460 drives the receiver device 30 and receives a satellite signal, it watches the subframe and page number in the satellite signal and determines the timing when the leap second value will be sent next. If the time until the leap second value will be transmitted is short (such as less than 60 seconds), the leap second acquisition unit 460 continues receiving and acquires the leap second value. If the time until the leap second value will be broadcast is long (such as 60 seconds or more), the leap second acquisition unit 460 pauses the reception process and then resumes the reception process timed to leap second value transmission.

Note that the navigation message is managed in one-week units, and when the leap second value is broadcast is fixed. The leap second acquisition unit 460 can therefore alternatively execute the reception process timed to leap second transmission based on the internal time kept by the timekeeping unit 50.

Evaluation Conditions Setting Unit

The evaluation conditions setting unit 470 sets a condition for determining if the leap second value (the current leap second) acquired by the leap second acquisition unit 460 is correct. A specific method of setting this condition is described below.

Leap Second Correction Unit

Using the leap second value acquired by the leap second acquisition unit 460 and determined correct by the evaluation conditions setting unit 470, the leap second correction unit 480 corrects the leap second value (current leap second value) stored in the leap second event data 620.

Control Device Operation

Figure 7:
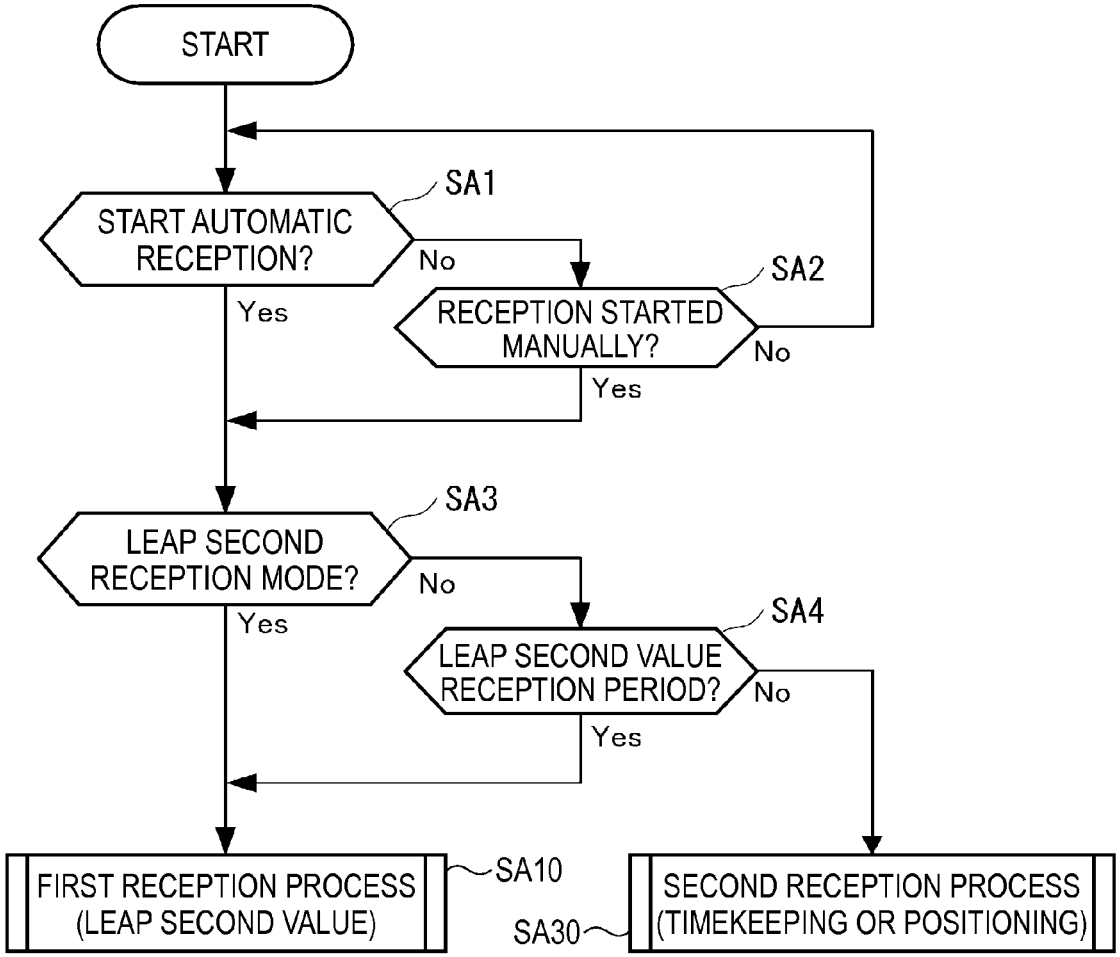
FIG. 7 is a flow chart showing the reception process in the first embodiment of the invention.

FIG. 7 is a flow chart of the reception process of the electronic timepiece 1 according to the first embodiment of the invention.

When starting the reception process, the control device 40 determines if the condition for starting automatic reception is met (SA1). As described above, the control device 40 determines that the condition for starting automatic reception is met (SA1 returns YES) if it is the scheduled reception time or if the output voltage or current from the solar panel 22 is greater than or equal to a set level.

If SA1 returns NO, the control device 40 determines if the pusher 15 was pressed for a first set time (such as 3 seconds) (SA2).

If SA2 returns NO, the control device 40 returns to SA1. The control device 40 therefore does not run the reception process until automatic reception starts (SA1 returns YES), or reception is started manually (SA2 returns YES).

If a condition for starting automatic reception is met (SA1 returns YES), or reception was started manually (SA2 returns YES), the control device 40 determines if the leap second reception mode is set (SA3). More specifically, if the reception mode stored in the time zone data storage unit 680 is set to the leap second reception mode, and the condition for starting automatic reception is met or reception was started manually, the control device 40 returns YES in SA3.

However, if SA3 returns NO, the control device 40 determines if the current time is in the leap second reception period (SA4). As described above, if the current date from the internal time is June 1 to 30 or December 1 to 31, and leap second reception has not succeeded in this period, the control device 40 returns YES in SA4.

When SA3 returns YES or SA4 returns YES, the control device 40 drives the leap second acquisition unit 460 and executes a first reception process to acquire the leap second value (SA10).

However, when SA3 returns NO or SA4 returns NO, the control device 40 executes a second reception process to receive satellite signals in the normal timekeeping mode or positioning mode (SA30).

First Reception Process

The process of the first reception mode is described next based on FIG. 8.

The leap second acquisition unit 460 first sets the reception mode (SA11). More specifically, if step SA3 in FIG. 7 returns YES, the leap second acquisition unit 460 sets the reception mode to the leap second reception mode. If YES was returned in step SA4 in FIG. 7, the leap second acquisition unit 460 sets the preset reception mode (timekeeping mode or positioning mode).

The control device 40 then drives the timekeeping unit 410, navigation unit 420, and leap second acquisition unit 460 and starts the reception process according to the set reception mode (SA12).

More specifically, in the timekeeping mode, the timekeeping unit 410 drives the receiver device 30 to find a GPS satellite 100 that can be locked onto, and locks onto at least one GPS satellite 100. After locking onto a GPS satellite 100, the timekeeping unit 410 receives the satellite signal through the receiver device 30 and acquires the time information.

In the positioning mode, the navigation unit 420 drives the receiver device 30 to find a GPS satellite 100 that can be locked onto, and locks onto at least three GPS satellites 100. After locking onto the GPS satellites 100, the navigation unit 420 receives the satellite signals through the receiver device 30 and acquires the positioning information. Note that because time information can be acquired simultaneously to acquiring the positioning information, the navigation unit 420 acquires time information in addition to the positioning information. The navigation unit 420 can alternatively be controlled to acquire only the positioning information.

In the leap second reception mode, the leap second acquisition unit 460 drives the receiver device 30 to find a GPS satellite 100 that can be locked onto, and locks onto at least one GPS satellite 100, similarly to the timekeeping unit 410. After locking onto a GPS satellite 100, the leap second acquisition unit 460 receives the satellite signal through the receiver device 30 and acquires the time information.

The control device 40 then determines if reception was successful (SA13). More specifically, if the time information was acquired, reception was successful if the acquired time information is determined to be correct by comparison with the internal time. If the positioning information was acquired, reception was successful if the acquired time information and positioning information are determined to be correct by comparing the time information acquired from the plural GPS satellites 100.

The control device 40 terminates the reception process if NO is returned in SA13.

If SA13 returns YES, the control device 40 waits until it is time to receive the leap second value (SA14).

As described above, the leap second value is transmitted every 12.5 minutes. Therefore, if reception is continued in order to receive the leap second value after reception starts in SA12, the reception process must continue for up to 12.5 minutes. In this event, the reception time becomes long and power consumption increases.

Therefore, if reception is determined successful in SA13, the control device 40 can also know the subframe and page number of the received satellite signal, and can determine when the leap second value will be broadcast (the time when receiving leap second value starts). As a result, the control device 40 determines if it is time to start receiving the leap second value (SA15), and if NO is returned, continues waiting to receive the leap second value (SA14).

When SA15 returns YES, the control device 40 drives the leap second acquisition unit 460 to start the leap second value reception process (SA16). The leap second acquisition unit 460 drives the receiver device 30 to find a GPS satellite 100 that can be locked onto, and locks onto at least two GPS satellites 100. Once the GPS satellites 100 are locked, the leap second acquisition unit 460 receives satellite signals with the receiver device 30, and acquires the leap second value from the two GPS satellites 100.

Note that the leap second value reception start time described above is set to accommodate the search time required to find GPS satellites 100.

The control device 40 then determines if leap second value was obtained from two or more GPS satellites 100 in one reception process (SA17). One reception process as used here means the reception process from when reception of leap second value starts (SA16) until the reception process ends or until reception times out.

If NO is returned by SA17, the control device 40 determines if reception timed out (SA18). This embodiment determines that reception timed out if at least 60 seconds have past since leap second value reception started (SA16).

If SA18 returns NO because less than 60 seconds have past since the start of leap second value reception, the control device 40 returns to SA17 and continues receiving the leap second value.

However, if SA18 returns YES and reception timed out, the control device 40 ends the reception process without correcting the internal time even if time information was successfully received in SA13.

If the control device 40 determines in SA17 that leap second value was received from two or more GPS satellites 100, it determines if the leap second value (the current leap second) acquired from the two or more GPS satellites 100 is the same (SA19). Because the stored leap second value is the current leap second, the leap second value acquired from plural GPS satellites 100 should be the same. Therefore, if the leap second values acquired from each GPS satellite 100 are not the same, the control device 40 can determine that signal strength is weak and the correct leap second value could not be acquired. However, if the same leap second value is acquired from each GPS satellite 100, the leap second value can be determined to be correct.

As a result, the control device 40 ends the reception process without correcting the internal time if NO is returned in SA19.

However, if YES is returned in SA19, the control device 40 can determine that the correct leap second value was acquired. In this event, the leap second correction unit 480 stores the acquired first or second leap second value (current leap second) in the leap second event data 620 of the memory device 60.

The time correction unit 450 then corrects the internal time data 630 using the current leap second value of the leap second event data 620 (SA20). When the internal time data 630 is corrected, the time data for display 640 is also corrected based on the set time zone data 650. The reception process then ends.

Second Reception Process

Figure 9:
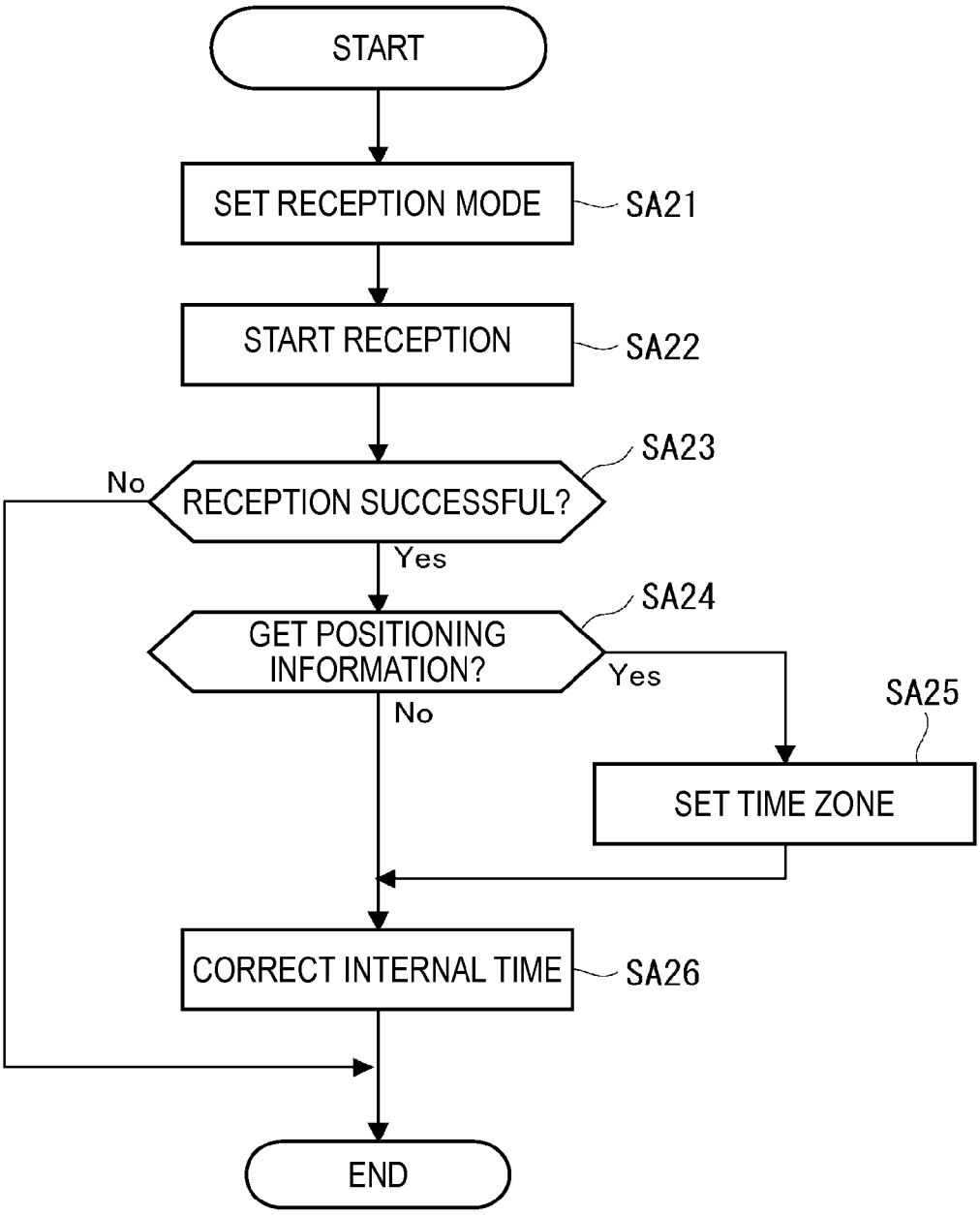
FIG. 9 is a flow chart showing a second reception process in the first embodiment of the invention.

The reception process of the second reception mode is described next based on FIG. 9.

If step SA4 in FIG. 7 returns NO, the control device 40 executes the reception process of the second reception mode. The control device 40 sets the preset reception mode (timekeeping mode or positioning mode) (SA21).

The timekeeping unit 410 starts the reception process if set to the timekeeping mode, and the navigation unit 420 starts the reception process if set to the positioning mode (SA22).

More specifically, in the timekeeping mode, the timekeeping unit 410 drives the receiver device 30 to find a GPS satellite 100 that can be locked onto, and locks onto at least one GPS satellite 100. After locking onto a GPS satellite 100, the timekeeping unit 410 receives the satellite signal through the receiver device 30 and acquires the time information.

In the positioning mode, the navigation unit 420 drives the receiver device 30 to find a GPS satellite 100 that can be locked onto, and locks onto at least three GPS satellites 100. After locking onto the GPS satellites 100, the navigation unit 420 receives the satellite signals through the receiver device 30 and acquires the positioning information. Note that because time information can be acquired simultaneously to acquiring the positioning information, the navigation unit 420 acquires time information in addition to the positioning information. The navigation unit 420 can alternatively be controlled to acquire only the positioning information.

The control device 40 then determines if reception was successful (SA23). This is determined in the same way as described in the first reception mode. The control device 40 terminates the reception process if NO is returned in SA23.

If SA23 returns YES, if the positioning information was acquired by the navigation unit 420, the control device 40 returns YES in SA24, gets the time zone data corresponding to the acquired positioning information from the time zone data storage unit 680, and sets the time zone data 650 (SA25).

After the time zone is set in SA25, or if NO is returned by SA24, the time correction unit 450 corrects the reception time data 610 based on the acquired time information, and corrects the internal time data 630 based on the leap second event data 620 (SA26). When the internal time data 630 is corrected, the time data for display 640 is also corrected based on the set time zone data 650.

Effect of Embodiment 1

The embodiment of the invention thus described has the following effect.

The electronic timepiece 1 updates the leap second value and corrects the internal time if leap second value is successfully acquired from two or more GPS satellites 100 in a single reception process and determined to match. As a result, the correctness of the received leap second value can be evaluated more accurately than when the correctness of the leap second value is determined based on a parity check.

Therefore, correcting the internal time using wrong leap second value can be prevented, and the accuracy of the displayed time can be improved.

Because the leap second acquisition unit 460 simultaneously locks onto two GPS satellites 100, acquires leap second values simultaneously, and terminates the leap second value reception process after one iteration, the reception time can be shortened and power consumption can be reduced compared with an implementation that acquires plural leap second values at different times, that is, in plural reception processes.

Because the leap second acquisition unit 460 delays reception until the leap second value transmission time, the time needed to receive the leap second value can be minimized and power consumption can be reduced.

Furthermore, because reception timing out is also considered, the reception process can be prevented from continuing for more than 60 seconds when the leap second value cannot be received, and power consumption can thereby also be reduced.

Embodiment 2

Figure 10:
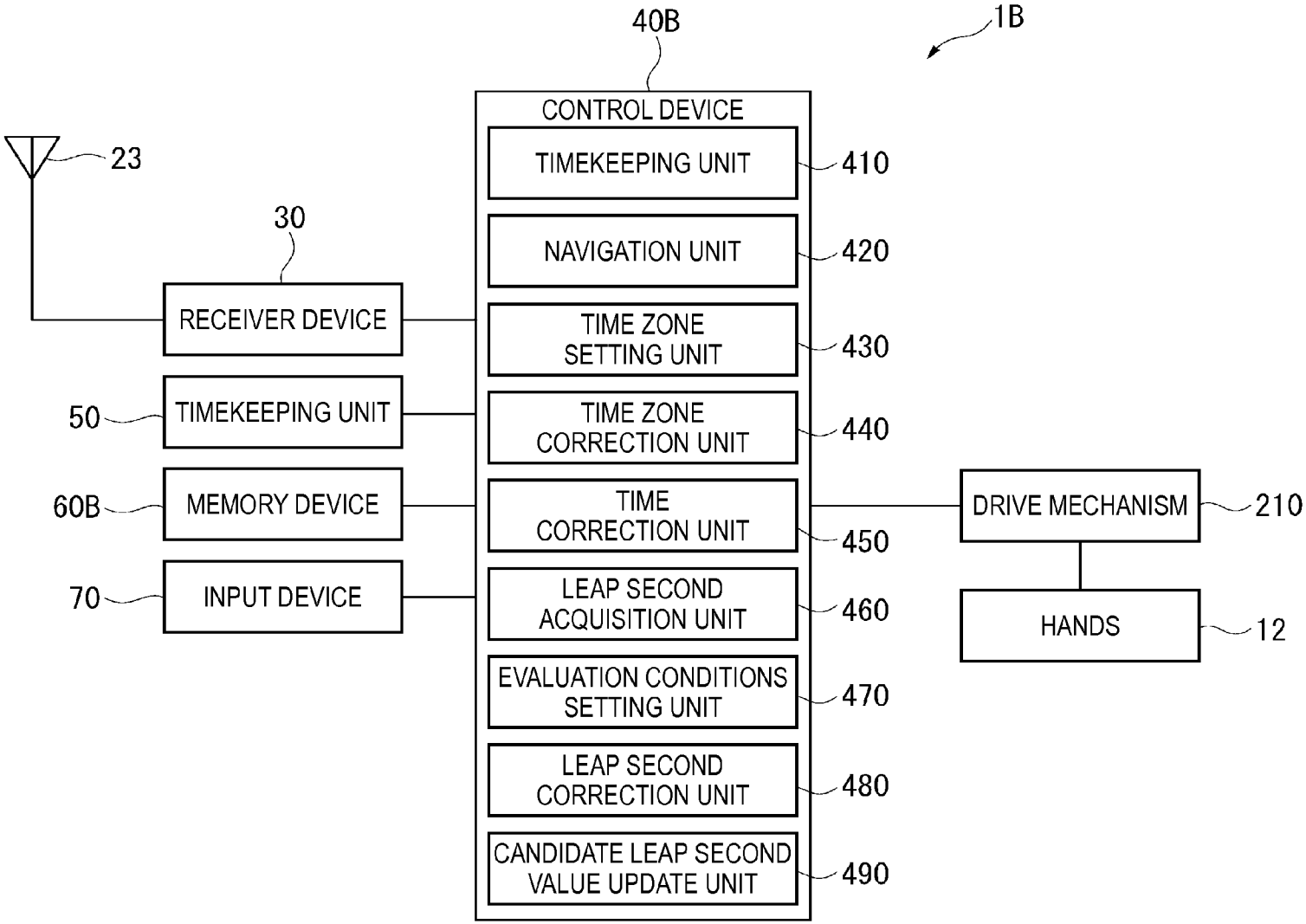
FIG. 10 is a block diagram showing the configuration of an electronic timepiece according to a second embodiment of the invention.
Figure 11:
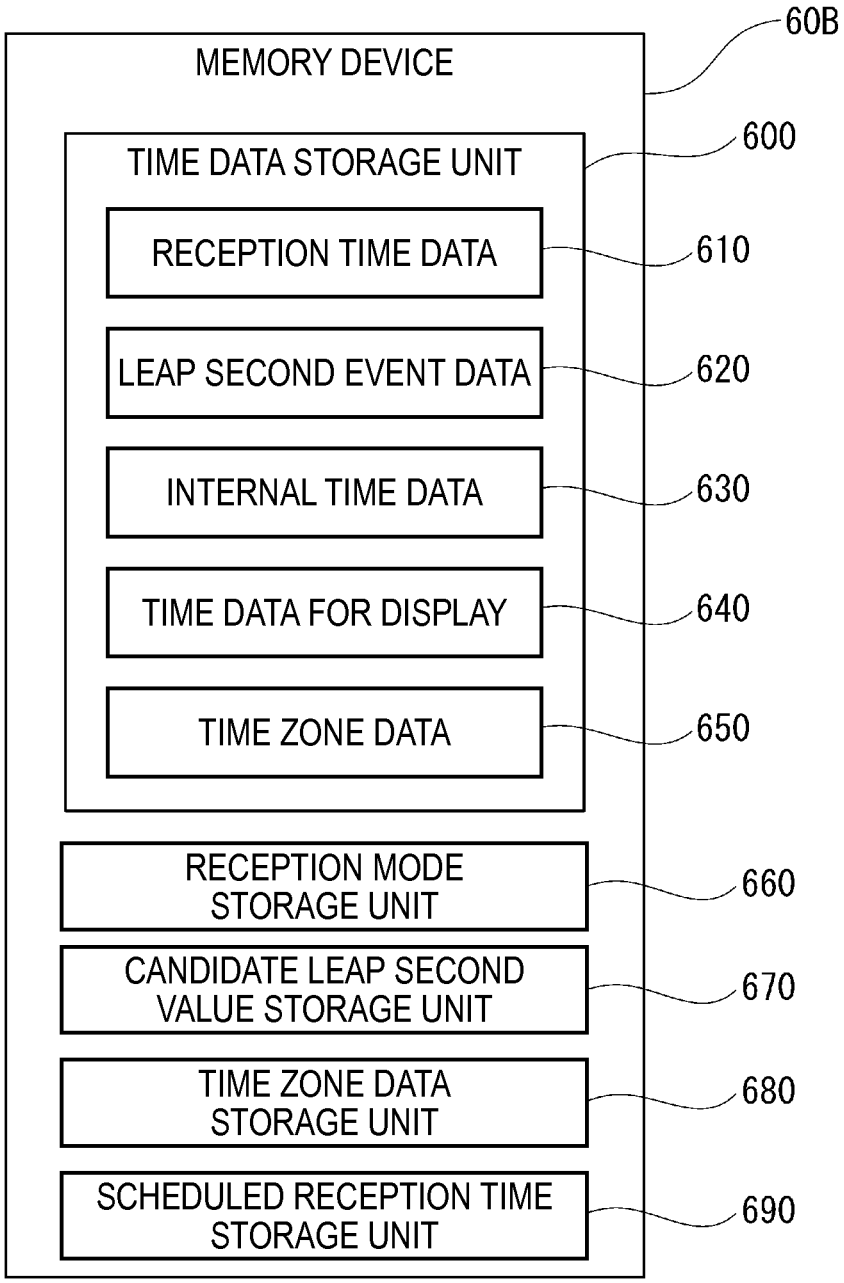
FIG. 11 is a block diagram showing the configuration of the memory device in the second embodiment of the invention.
Figure 12:
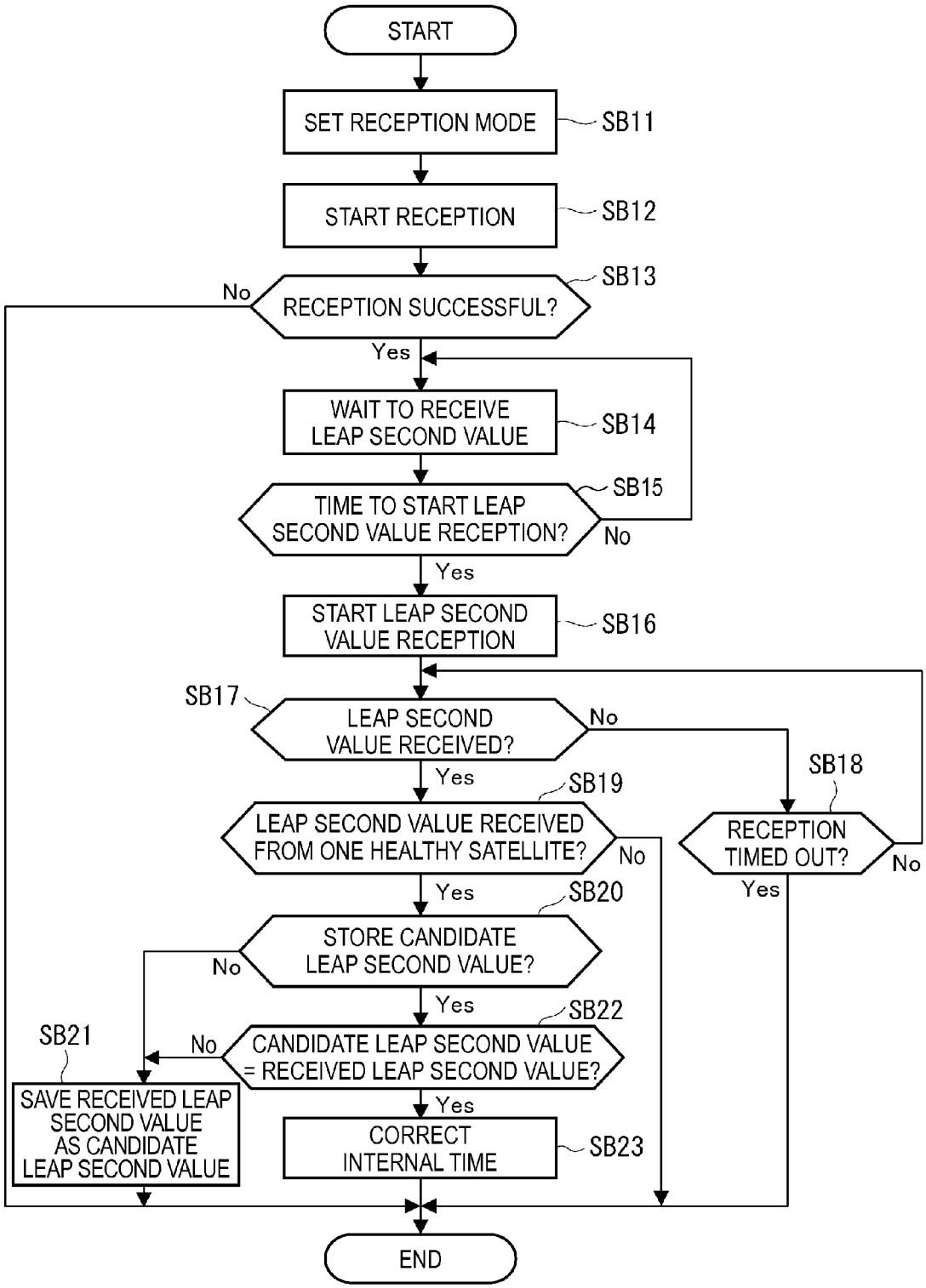
FIG. 12 is a flow chart showing a first reception process in the second embodiment of the invention.

A second embodiment of the invention is next with reference to FIG. 10 to FIG. 12. As shown in FIG. 10, the electronic timepiece 1B according to the second embodiment of the invention differs from the first embodiment by also having a candidate leap second value update unit 490. As shown in FIG. 11, the memory device 60B of the electronic timepiece 1B differs from the first embodiment by also having a candidate leap second value storage unit 670. Other aspects of the configuration of the second embodiment are the same as in the first embodiment.

As a result, the second embodiment further differs from the first embodiment in the reception process of the first reception mode that receives the leap second as shown in FIG. 12. Note that the reception process of the second reception mode is the same as in the first embodiment, and further description thereof is thus omitted.

To determine the reliability of the leap second value, the first embodiment determines if the two leap second values received in a single reception process from two GPS satellites 100 match. In contrast, the second embodiment uses a method that receives leap second values from GPS satellites 100 at different times (in at least two reception processes), and determines the leap second value can be used even if received from only one GPS satellite 100 at each reception time.

Figure 8:
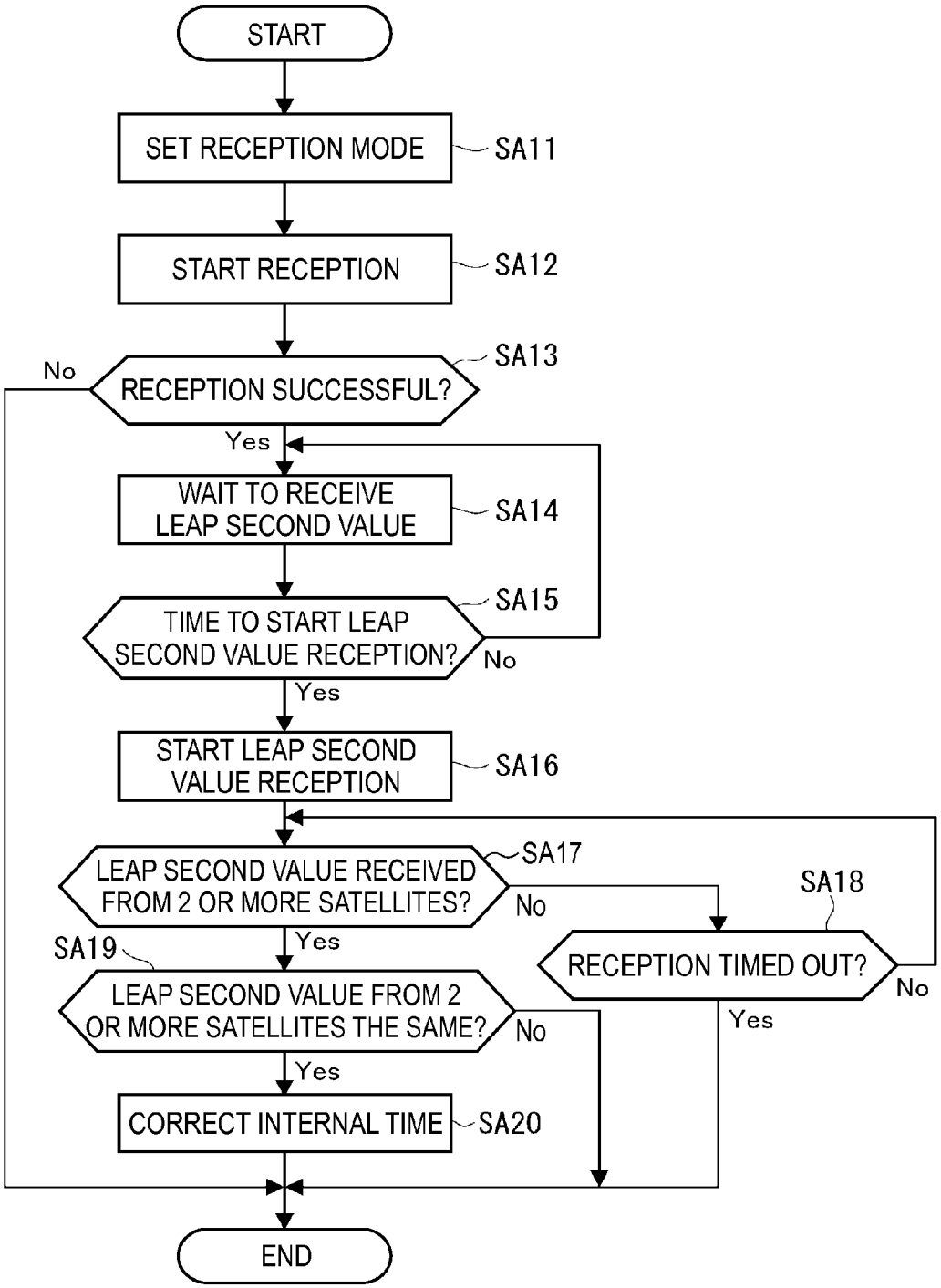
FIG. 8 is a flow chart showing a first reception process in the first embodiment of the invention.

As a result, steps SB11 to SB16 and SB18 in the first reception process are the same as steps SA11 to SA16 and SA18 of the first embodiment shown in FIG. 8, and description thereof is thus omitted.

After starting leap second value reception (SB16), the control device 40 determines if leap second value reception was successful (SB17). In this example, the control device 40 returns YES in SB17 if only one leap second value was received.

If SB17 returns YES in FIG. 12, the control device 40 determines if the leap second value was received from one healthy satellite (SB19).

A healthy satellite is a satellite for which the satellite health SVhealth bit is 0 (the navigation message is normal). The control device 40 therefore determines if the leap second value was received from a GPS satellite 100 for which the satellite health SVhealth bit in subframe 1 is 0.

If SB19 returns NO, the control device 40 terminates the current reception process without correcting the internal time.

If SB19 returns YES, the control device 40 determines if a candidate leap second value is stored in the candidate leap second value storage unit 670 (SB20).

If a candidate leap second value is not stored (SB20 returns NO), the received leap second value is made the first leap second value. The candidate leap second value update unit 490 of the control device 40 then stores the first leap second value in the candidate leap second value storage unit 670 of the memory device 60 (SB21). The current reception process then ends without correcting the internal time.

If a candidate leap second value is stored in the candidate leap second value storage unit 670 (SB20 returns YES), the control device 40 determines if the stored candidate leap second value (first leap second value) and the leap second value just received (second leap second value) are the same (SB22).

If SB22 returns NO, the candidate leap second value update unit 490 saves the received leap second value (second leap second value) in the candidate leap second value storage unit 670, and updates the candidate leap second value (SB21).

Because the correct leap second value was acquired if SB22 returns YES, and the leap second correction unit 480 stores the second leap second value or the candidate leap second value (first leap second value) in the leap second event data 620. The time correction unit 450 then corrects the internal time data 630 using the current leap second value of the leap second event data 620 (SB23). When the internal time data 630 is corrected, the time data for display 640 is also corrected based on the set time zone data 650. The reception process then ends.

Effect of Embodiment 2

In addition to achieving the same effect as the same configurations and steps in the first embodiment, this second embodiment of the invention also has the following effect.

The electronic timepiece 1B according to the second embodiment of the invention can accurately determine if an accurate leap second value was received even in a poor reception environment where a satellite signal can only be received from one GPS satellite 100. More specifically, when reception is possible from only one GPS satellite 100 at the time of reception (second reception process), the candidate leap second value that was stored during the previous reception attempt (first reception process) is compared with the leap second value received in the current reception process.

As a result, the correctness of the received leap second value can be evaluated more accurately than when the correctness of the leap second value is determined based on a parity check.

Therefore, correcting the time using wrong leap second value can be prevented and the accuracy of the displayed time can be improved even when reception is only possible from a single GPS satellite 100 in a single reception process.

A normal leap second value can also be reliably acquired because the satellite health SVhealth is checked at the time of leap second value reception. This also enables preventing correcting the time using a wrong leap second value and improving the accuracy of the displayed time when reception is only possible from a single GPS satellite 100 in a single reception process.

Furthermore, the candidate leap second value remaining fixed to the wrong value and the leap second values continuing to not match can also be prevented because the candidate leap second value is updated to the received second leap second value when SB22 returns NO.

Embodiment 3

A third embodiment of the invention is described next with reference to FIG. 13.

The electronic timepiece according to the third embodiment of the invention has the same configuration as the electronic timepiece of the second embodiment but differs in the content of the first reception process. Description of constructions and processes that are the same in the third embodiment and the second embodiment is therefore simplified or omitted.

Figure 13:
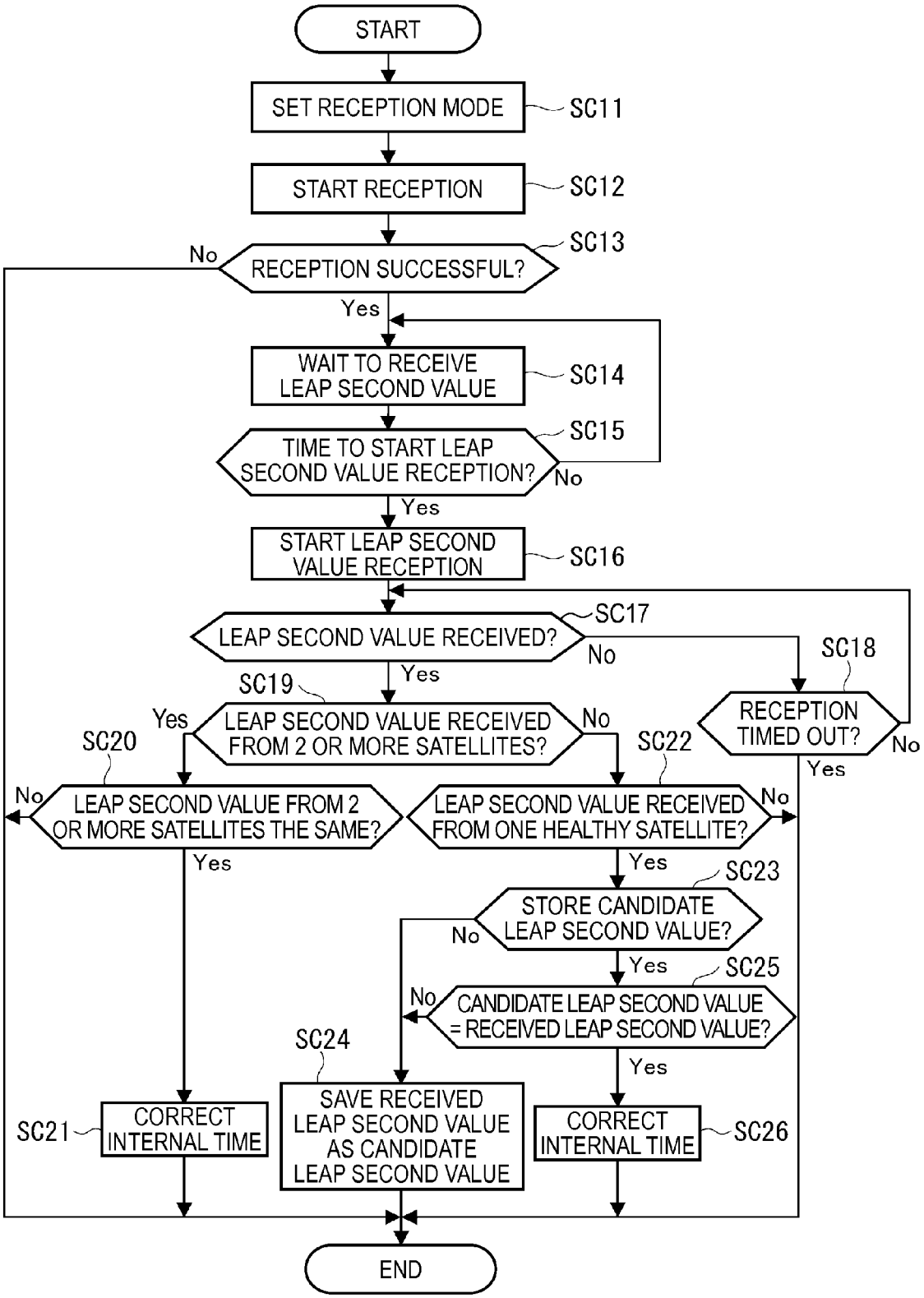
FIG. 13 is a flow chart showing a first reception process in a third embodiment of the invention.

As shown in FIG. 13, steps SC11 to SC18 that receive the leap second value are identical to steps SB11 to SB18 of the second embodiment shown in FIG. 12.

If YES is returned by SC17 in FIG. 13, the control device 40 determines if a leap second value was received from 2 or more satellites (SC19).

If SC19 returns YES, that is, a leap second value was received from 2 or more satellites, the control device 40 executes steps SC20 and SC21, which are identical to steps SA19 and SA20 in the first embodiment.

However, if SC19 returns NO, that is, the leap second value was received from only one satellite, the control device 40 executes steps SC22 to SC26, which are identical to steps SB19 to SB23 in the second embodiment.

Steps SC20 to SC26 are the same as SA19, SA20, and SB19 to SB23 of the first and second embodiments, and further description thereof is omitted.

Effect of Embodiment 3

In addition to achieving the same effect as the same steps in the first and second embodiments, this third embodiment of the invention also has the following effect.

When the leap second value is received, this aspect of the invention can determine if the acquired leap second value is correct using the appropriate method corresponding to the number of satellites from which the leap second value was received. Therefore, whether or not accurate leap second value could be received can be determined accurately both when the leap second value is acquired from only one GPS satellite 100, and when the leap second value is acquired from two or more GPS satellites 100, depending upon the reception environment. As a result, the correctness of the received leap second value can be evaluated more accurately than when the correctness of the leap second value is determined based on a parity check.

Therefore, correcting the time using an incorrect leap second value can be prevented and the accuracy of the displayed time can be improved.

Embodiment 4

Figure 14:
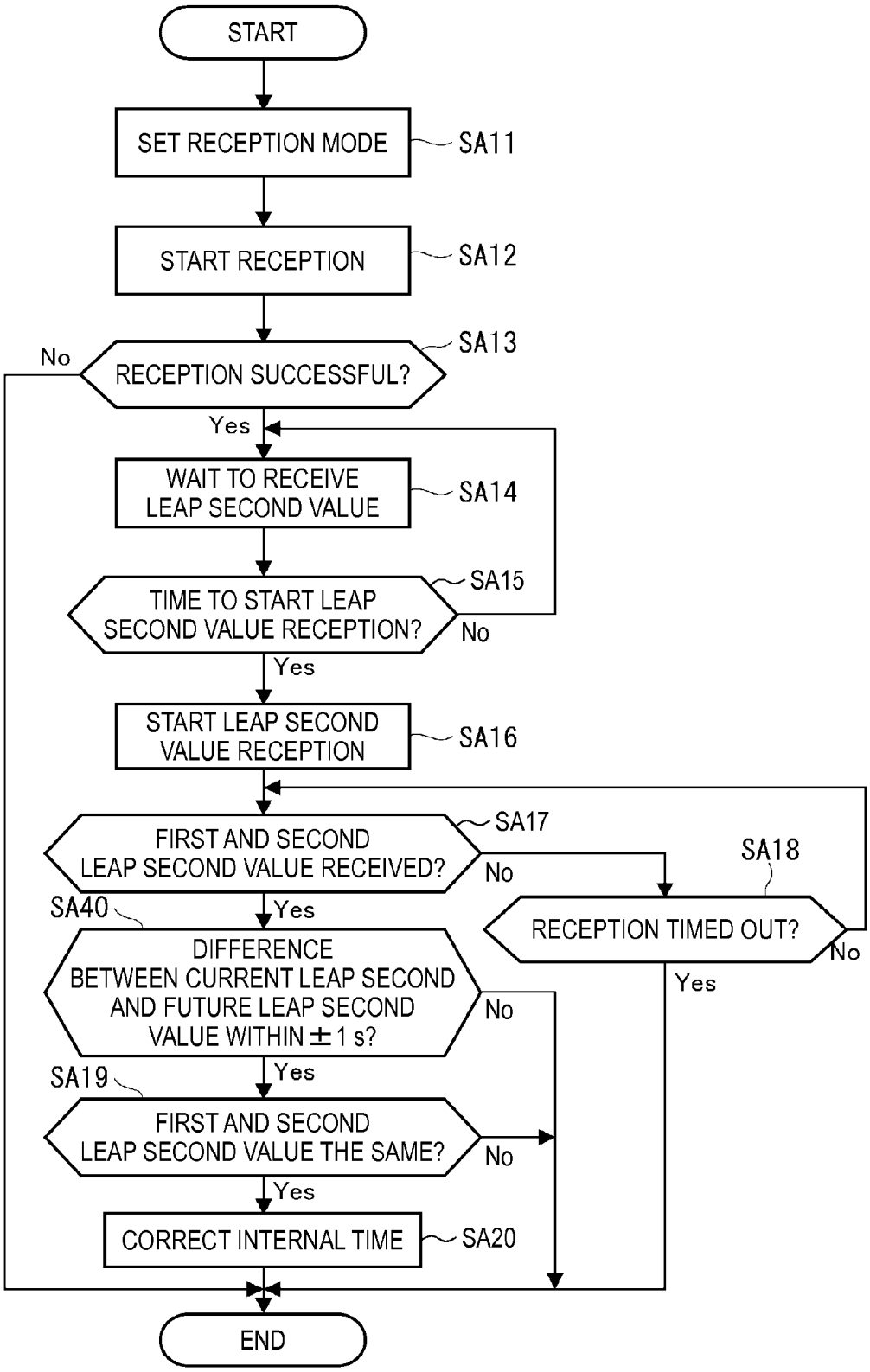
FIG. 14 is a flow chart showing a first reception process in a fourth embodiment of the invention.

A fourth embodiment of the invention is described next with reference to FIG. 14. This fourth embodiment adds a leap second value evaluation condition to the first reception process of the first embodiment. More specifically, decision step SA40 is added as shown in FIG. 14.

If SA17 returns NO in this fourth embodiment, the control device 40 determines if the difference between the received leap second value (current leap second value) and the future leap second value is within ±1 second (SA40). Note that this test is applied to both the first and second satellite signals.

As described above, the future leap second value can be acquired when a satellite signal containing the leap second value is received. The difference between the leap second value acquired by signal reception (the current leap second) and the future leap second value should be within ±1 second. It is therefore possible that correct leap second data could not be received when SA40 returns NO, and the control device 40 ends the reception process without correcting the internal time.

However, if SA40 returns YES, the control device 40 applies the test of SA19, and corrects the internal time if SA19 returns YES (SA20).

Note that the order of tests of SA40 and SA19 can be reversed because it does not matter which condition is tested first.

In addition to achieving the same effect as the first embodiment, this fourth embodiment of the invention can also evaluate the correctness of the leap second value more accurately by adding the conditional test of SA40.

Note that the test of SA40 in this fourth embodiment can also be added to the embodiments described above. More specifically, the test of SA40 can be additionally applied when a first satellite signal and a second satellite signal are received.

Embodiment 5

Figure 15:
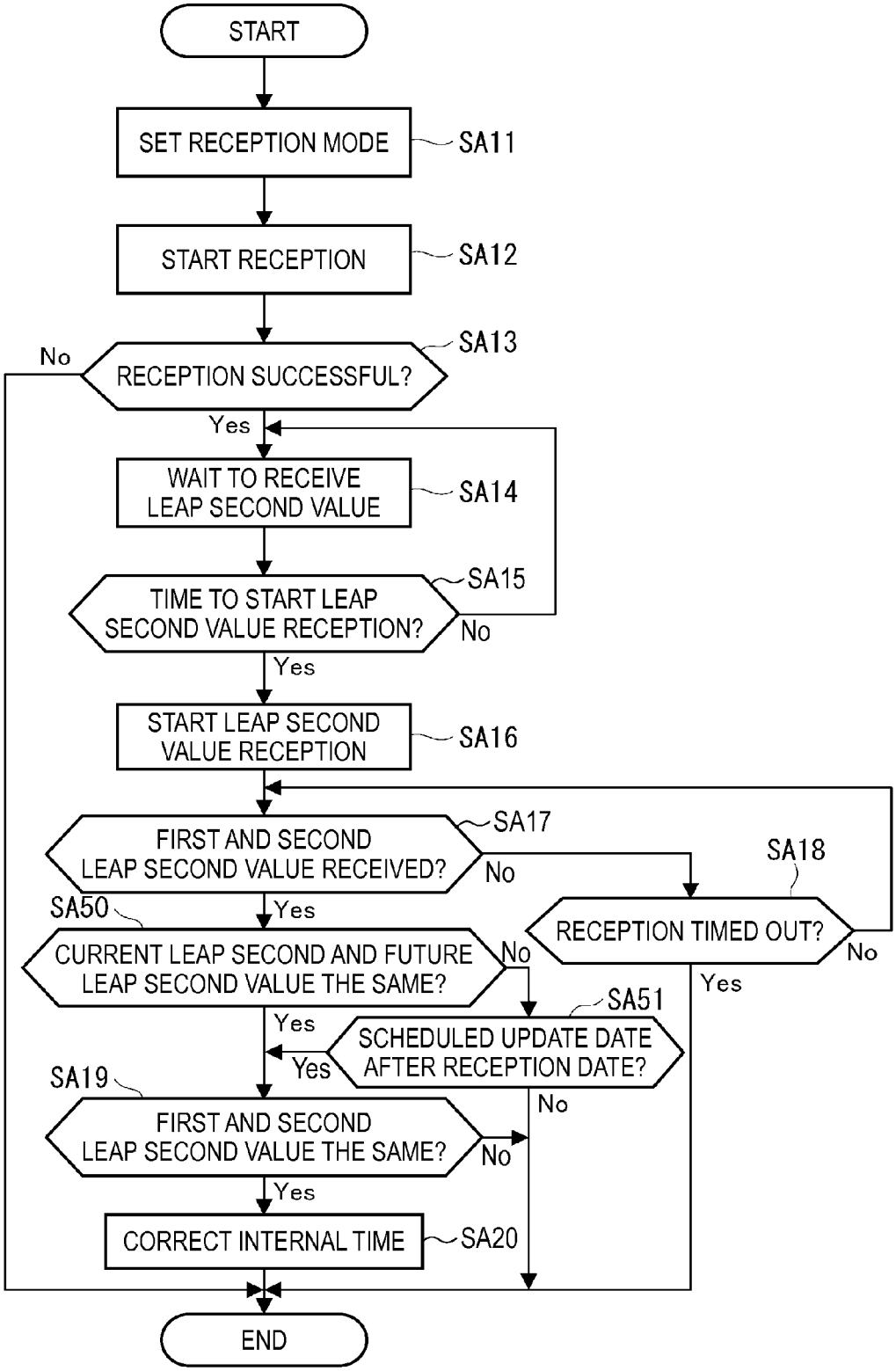
FIG. 15 is a flow chart showing a first reception process in a fifth embodiment of the invention.
Figure 16:
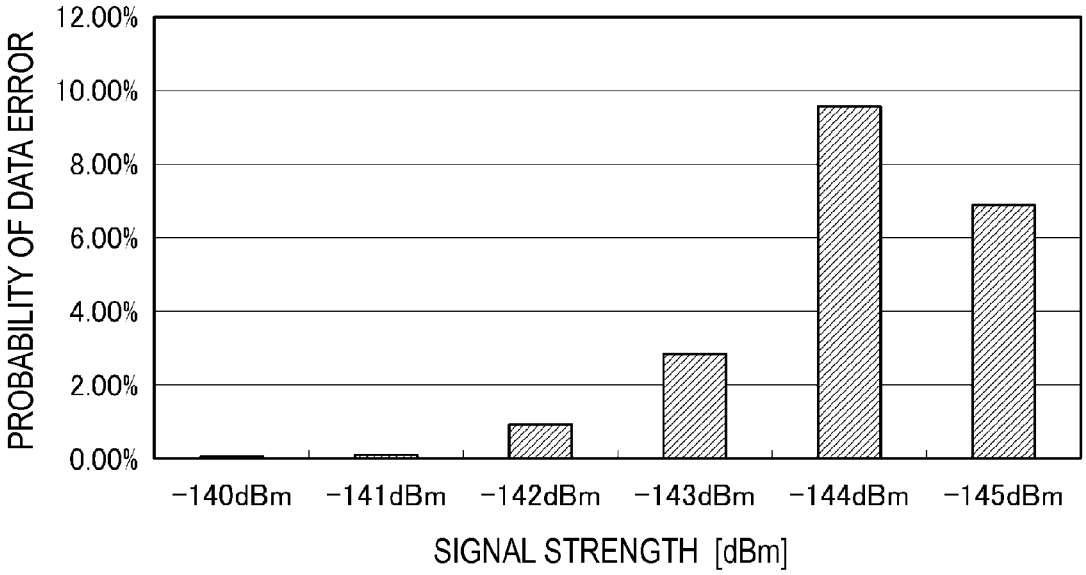
FIG. 16 is a graph describing a problem solved by the invention.

A fifth embodiment of the invention is next with reference to FIG. 15.

This fifth embodiment adds a leap second value evaluation condition to the first reception process of the first embodiment. More specifically, decision steps SA50 and SA51 are added as shown in FIG.

More specifically, when SA17 returns YES in this fifth embodiment, the control device 40 determines of the received leap second value (current leap second) and the future leap second value match (SA50).

If the leap second value (current leap second) that was received is different from the future leap second value, and SA50 returns NO, the control device 40 determines if the scheduled leap second event is later than the reception date (SA51). Note that steps SA50 and SA51 are applied to the first and second satellite signals.

As described above, if a leap second event is not scheduled when a satellite signal containing a leap second value is received, the future leap second value will match the current leap second value. However, if a leap second event has been announced, the future leap second value will be different from the current leap second value and the date of the next leap second event is set. The date of the leap second event is naturally after the reception date. Therefore, because receiving the correct leap second value may not possible when the condition of SA51 is not satisfied and NO is returned, the control device 40 ends the reception process without correcting the internal time.

However, when SA50 returns YES, and when SA51 returns YES, the control device 40 applies the evaluation step of SA19, and corrects the internal time if SA19 returns YES (SA20).

Note that the order of tests of SA50, SA51, and SA19 can be changed because it does not matter which condition is tested first.

In addition to achieving the same effect as the first embodiment, this fifth embodiment of the invention can also evaluate the correctness of the leap second value more accurately by adding the conditional tests of SA50 and SA51.

Note that the tests of SA50 and SA51 in this fifth embodiment can also be added to the embodiments described above. More specifically, the tests of SA50 and SA51 can be additionally applied when a first satellite signal and a second satellite signal are received.

Other examples

The invention is not limited to the embodiments described above, and can be varied in many ways without departing from the scope of the accompanying claims.

For example, when the leap second value is acquired from two or more GPS satellites 100 in the first and third embodiments, a condition determining if the leap second value was acquired from two healthy GPS satellites 100, that is, satellites with the satellite health SVhealth bit set to 0. The reliability of the acquired leap second value can be further improved by evaluating satellite health when two satellite signals are acquired simultaneously (in a single reception process).

That the signal strength of the received satellite signal is greater than or equal to a set level can also be added as a condition for evaluating the leap second value. This is because an incorrect leap second value could be received due to noise, for example, if the signal strength is weak.

The leap second reception mode can be selected in the foregoing embodiments, but a configuration that does not have a leap second reception mode and enables selecting only a timekeeping mode and a positioning mode is also conceivable. In this event, leap second value can be acquired automatically during the leap second reception period.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

An electronic timepiece according to the invention is not limited to wristwatches, and can be used in a wide range of electronic timepieces with the ability to receive satellite signals and correct the internal time, including table clocks, wall clocks, cell phones, and portable GPS receivers used in trekking and other outdoor sports.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2013-72717, filed Mar. 29, 2013 is expressly incorporated by reference herein.

What is claimed is:

1. An electronic timepiece comprising:

a receiver unit that receives at least one satellite signal containing a respective leap second value during a single reception process;

a time data storage unit that stores a current leap second;

a timekeeping unit that keeps time according to the current leap second;

an evaluation condition setting unit that sets a first evaluation condition of the correctness of the satellite signals received in the single reception process if the number of satellite signals received within the reception process is not greater than a predefined number, and sets a second evaluation condition of the correctness of the satellite signals received in the single reception process if the number of satellites received within the reception process is greater than the predefined number, the first evaluation condition being different than the second evaluation condition; and a leap second correction unit that corrects the current leap second stored in the time data storage unit based on the leap second value of any of the satellite signals received within the reception process if the first or second evaluation condition that is set by the evaluation condition setting unit is satisfied;

a candidate leap second value storage unit that stores a candidate leap second value, the candidate leap second value being a leap second value contained in a previous satellite signal received in a past reception process executed before the single reception process;

wherein the first evaluation condition includes:

the leap second value contained in a selected one of the satellite signals received within the single reception process and the candidate leap second value stored in the candidate leap second value storage unit are the same.

2. The electronic timepiece described in claim 1, further comprising:

wherein the first evaluation condition further includes:

determining if the selected one of satellite signals received within the reception process is received from a positioning information satellite in normal satellite health condition.

3. The electronic timepiece described in claim 2, further comprising:

a candidate leap second value updating unit;

wherein the first evaluation condition further includes:

if the respective leap second value of the selected satellite signal is determined to not be the same as the candidate leap second value stored in the candidate leap second value storage unit, then updating the candidate leap second value to the leap second value contained in the selected satellite signal.

4. The electronic timepiece described in claim 1, wherein the second evaluation condition includes:

the leap second values from any two satellite signals received by the receiver unit during the same single reception process are equal.

5. The electronic timepiece described in claim 1, further comprising:

wherein the first evaluation condition further includes:

if no candidate leap second value is stored in the candidate leap second value storage unit, then storing the leap second value of any of the satellite signals received by the receiver unit during the single reception process into the candidate leap second value storage unit as the candidate leap second value, and determining that the evaluation condition is not satisfied;

if the candidate leap second value is stored in the candidate leap second value storage unit, then determining if the selected one of the satellite signals received within the reception process is from a positioning information satellite in normal satellite health; and wherein the second evaluation condition includes:

the leap second values from any two satellite signals received by the receiver unit during the same single reception process are equal.

6. The electronic timepiece described in claim 1, wherein:

the first and second evaluation conditions include determining if the received satellite signals were received from positioning information satellites in normal satellite health.

7. The electronic timepiece described in claim 1, wherein:

said at least one satellite signal additionally contains a future leap second value; and at least one of said first evaluation condition and second evaluation condition includes determining if the difference between the leap second value contained in the selected one of the received satellite signals and the future leap second value contained in the selected one of the received satellite signals is within a range from −1 second to +1 second.

8. The electronic timepiece described in claim 1, wherein:

said at least one satellite signal additionally contains a future leap second value and a scheduled leap second event; and at least one of said first evaluation condition and second evaluation condition includes determining if the scheduled leap second event of the selected one of the received satellite signals is after the date that the selected satellite signal was received if the respective leap second value and future leap second value of the selected one of the received satellite signals are different values.

9. The electronic timepiece of claim 1, wherein the reception process is from when reception of leap second value information starts until the reception process ends or until reception times out.

10. The electronic timepiece of claim 1, wherein said predefined number is one.

11. The electronic timepiece of claim 1, wherein:

the reception process is from when reception of leap second value information starts until the reception process ends or until reception times out; and said predefined number is one.

12. The electronic timepiece described in claim 11, wherein the second evaluation condition includes:

determining if the leap second values from any two satellite signals received by the receiver unit during the same single reception process are equal.

13. The electronic timepiece described in claim 12, wherein the first evaluation condition further includes:

if no candidate leap second value is stored in the candidate leap second value storage unit, then storing the leap second value of the one received satellite signal into the candidate leap second value storage unit as the candidate leap second value, and determining that the evaluation condition is not satisfied.

14. An electronic timepiece comprising:

a time data storage unit that stores a current leap second;

a timekeeping unit that keeps time according to the current leap second;

a receiver unit that receives a first satellite signal in a first time reception process to receive first current time information, and receives a second satellite signal after the first satellite signal in a second time reception process to receive second current time information that is different from the first current time information, the second time reception process being executed after the first time reception process ends;

a candidate leap second value storage unit that stores a first leap second value contained in the first satellite signal as a candidate leap second value; and a leap second correction unit that corrects the current leap second stored in the time data storage unit based on at least one of a second leap second value contained in the second satellite signal and the candidate leap second value when the second leap second value is the same as the candidate leap second value.

15. A reception control method of an electronic timepiece having a receiver unit that receives satellite signals, and a timekeeping unit that keeps time according to the current leap second, the control method comprising:

providing a time data storage unit that stores a current leap second;

receiving at least one satellite signal containing a respective leap second value during a single reception process;

setting a first evaluation condition of the correctness of the leap second value of the satellite signal received in the single reception process if the number of satellite signals received within the reception process is one, and setting a second evaluation condition of the correctness of the leap second values of the satellites received in the single reception process if the number of satellites signals received within the reception process is greater than one; and correcting the current leap second stored in the time data storage unit to the leap second value that satisfied the set evaluation condition;

storing a candidate leap second value in a candidate leap second value storage unit, the candidate leap second value being the leap second value which is contained in a previous satellite signal received in a past reception process executed before said single reception process;

wherein the first evaluation condition includes:

the leap second value contained in a selected one of the satellite signals received within the reception process and the candidate leap second value stored in the candidate leap second value storage unit are the same.

* * * * *